US008578625B2

(12) United States Patent
Franich et al.

(10) Patent No.: US 8,578,625 B2
(45) Date of Patent: Nov. 12, 2013

(54) WOOD DRYING

(75) Inventors: Robert Arthur Franich, Rotorua (NZ); Sheryl Suzanne Gallagher, Rotorua (NZ); Hendricus Wilhelmus Kroese, Rotorua (NZ)

(73) Assignee: New Zealand Forest Research Institute Limited, Rotorua (NZ)

( * ) Notice: Subject to any disclaimer, the term of this patent is extended or adjusted under 35 U.S.C. 154(b) by 945 days.

(21) Appl. No.: 12/312,424

(22) PCT Filed: Oct. 29, 2007

(86) PCT No.: PCT/NZ2007/000326

§ 371 (c)(1), (2), (4) Date: Oct. 21, 2009

(87) PCT Pub. No.: WO2008/091163

PCT Pub. Date: Jul. 31, 2008

(65) Prior Publication Data

US 2010/0058607 A1 Mar. 11, 2010

(30) Foreign Application Priority Data

Nov. 10, 2006 (NZ) ..... 551265

(51) Int. Cl.
*F26B 3/34* (2006.01)

(52) U.S. Cl.
USPC ..... 34/367; 34/381; 34/496; 34/413; 34/497; 426/422; 426/429; 264/177.2; 530/202; 162/64; 427/384

(58) Field of Classification Search
USPC ..... 34/367, 381, 396, 413, 467, 468, 497.9, 34/201; 426/234, 422, 429; 264/177.2, 264/211; 530/202; 162/63, 64; 427/384
See application file for complete search history.

(56) References Cited

U.S. PATENT DOCUMENTS

| | | | | |
|---|---|---|---|---|
| 4,308,200 | A | 12/1981 | Fremont | |
| 4,791,020 | A | 12/1988 | Kokta | |
| 4,995,943 | A | 2/1991 | Rehberg | |
| 5,041,192 | A | 8/1991 | Sunol et al. | |
| 5,344,493 | A * | 9/1994 | Jackson | 134/1 |
| 6,261,679 | B1 * | 7/2001 | Chen et al. | 428/317.9 |
| 6,610,232 | B2 | 8/2003 | Jacobsen | |
| 6,638,574 | B1 | 10/2003 | Qader | |
| 2003/0134015 | A1 * | 7/2003 | Plaschke | 426/234 |
| 2005/0208317 | A1 * | 9/2005 | Henriksen et al. | 428/537.1 |
| 2008/0033127 | A1 * | 2/2008 | Jiang et al. | 526/206 |
| 2010/0058607 | A1 * | 3/2010 | Franich et al. | 34/255 |

FOREIGN PATENT DOCUMENTS

| | | |
|---|---|---|
| EP | 0319589 | 6/1989 |
| EP | 1070782 | 1/2001 |
| JP | 08-005237 | 1/1996 |
| JP | 10-076501 | 3/1998 |

(Continued)

OTHER PUBLICATIONS

Derwent Abstract Accession No. 2007-035308/05, Class P63, DE 510017963 A1, Degussa AG, Oct. 26, 2006, 1 page.

(Continued)

*Primary Examiner* — Steven M Garvin
(74) *Attorney, Agent, or Firm* — Jacobson Holman PLLC

(57) ABSTRACT

A process for removing water and solutes from the lumens of green wood, while leaving the cell walls throughout the wood uniformly fully swollen, comprises subjecting the green wood to supercritical carbon dioxide.

33 Claims, 16 Drawing Sheets

(56) References Cited

FOREIGN PATENT DOCUMENTS

| | | |
|---|---|---|
| JP | 2002-067008 | 3/2002 |
| JP | 2003-285301 | 10/2003 |
| JP | 2005-096234 | 4/2005 |
| JP | 2005-524552 | 8/2005 |
| JP | 2005-246872 | 9/2005 |
| JP | 2007-111693 | 5/2007 |
| JP | 2007-216438 | 8/2007 |
| WO | WO 9816288 A1 * | 4/1998 |
| WO | 03/095165 | 11/2003 |
| WO | 2005/049170 | 6/2005 |
| WO | WO 2008091163 A1 * | 7/2008 |

OTHER PUBLICATIONS

Report to Foundation for Research Science & Technology, Contract No. CO4X0205, "Wood Products for the Future," Research Leader Dr. David Cowan, Aug. 1, 2003, 4 pages.

Jones, et al., "Decompression Drying of Pinus Radiate Sapwood Chips", Forest Products Journal (1999), 49(1), 67-72.

* cited by examiner

WOOD DRYING

This is a national stage of PCT/NZ07/000326 filed Oct. 29, 2007 and published in English, which has a priority of New Zealand no. 551265 filed Nov. 10, 2006, hereby incorporated by reference.

FIELD OF THE INVENTION

The present invention relates to a process for the selective removal of water and solutes from wood using a supercritical carbon dioxide. In particular, but not exclusively, the invention relates to the use of supercritical carbon dioxide for the removal of water and solutes from the lumens of green wood while leaving the cell walls fully swollen and in their green state. The present invention also relates to a method of drying wood for utility purposes.

BACKGROUND TO THE INVENTION

Wood in its natural state, in a living tree or newly cut lumber for example, often has a high moisture content with the moisture content varying depending on the particular type and location of the wood and the type and condition of the tree. The moisture is made up of bound water, that is, water bound within the cell walls and bound to carbohydrates and lignin polymers that are components of the cell walls, and free water, that is, water in the lumens. The lumens also often contain sap and other solutes in the free water. Although there is great variation between tree species it is not unusual for moisture content to be in the vicinity of 160%-200% (of the oven-dry weight of the wood).

For utility purposes, unless it is dried (a process known as seasoning), wood with a high moisture content, herein 'green wood', has undesirable properties including instability during drying and susceptibility to deterioration. Changes in the dimensions of wood due to changes in moisture content create significant problems when used in construction. It is therefore common practice to dry green wood in an attempt to produce a stable, practical material and to maximise its utility value. Because of the non-uniformity of wood and its high moisture content, it is not uncommon for the drying of wood to result in distortion of the wood or to cause damage to the wood structure such as warping and internal and surface checking.

The two common techniques used to dry green wood are air-drying and oven- or kiln-drying.

In air-drying, green wood is left to dry passively in the ambient air. This technique is climate dependent and is generally a slow process. The advantage of passive air-drying is simplicity and that it is a mild process (relative to kiln-drying) with the wood material not being subjected to high temperatures and high forced internal moisture gradient stress that may occur in kiln-drying. In oven- or kiln-drying, green wood is placed in an insulated chamber within which heated air is circulated. While this technique overcomes the disadvantage of air-drying namely being slow, it can result in other undesirable effects, such as kiln stains, which are dark coloured regions that are formed on the wood, and higher internal moisture gradient stresses (for instance the outside of the wood dries while the inside remains wet) that can cause a higher rate of checking or warping of the wood. These effects detract from wood quality, yield and value.

Changes in the dimensions, strength and flexibility of wood occur when the wood's cell walls lose bound water. Moisture gradient stress often occurs in conventional drying when parts of the wood (often the wood close to the surfaces in air or kiln drying) lose moisture from the lumens and from the cell walls at a greater rate than water is lost from the cell walls and lumens of other parts of the wood. Imaging of wood during the drying process when being air or kiln-dried shows the wood with dry edges and a wet core. The results are changes to the dimension and strength of some parts of the wood at rates and extents different to the changes in other parts of the wood. The result is often damage to the structure of the wood and distortion.

Techniques have been used to dry wood other than passive air-drying and kiln-drying. These include dehumidification, the use of azeotropes to distil water from green wood at temperatures below that of the boiling point of water, and also freeze-drying, where the water in green wood is frozen and subsequently removed by sublimation process. However, these techniques also create moisture gradient stress (although sometimes with different patterns of moisture distribution) and cause damage to cell walls and wood.

It is also known to dry wood by electromagnetic radiation drying such as radio frequency drying and microwave drying. Radio frequency vacuum ('RFV') drying in particular, results in less moisture gradient stress than air or kiln drying but these methods are time consuming and requires high energy input particularly when the wood has high moisture content. They are, however, more energetically viable and quick when used on wood with reduced moisture content, for instance, wood at or close to fibre saturation point.

Supercritical fluids are fluids that exhibit properties of both gas and liquid when subject to temperatures and pressures above those of the critical point of the fluid. A fluid in a supercritical state thus has the solvating abilities of a liquid, but with a gas-like diffusivity.

The use of supercritical fluids in wood processing other than for wood drying purposes is known. In U.S. Pat. No. 6,638,574, supercritical fluids are used for impregnating preservatives into wood, while in U.S. Pat. No. 4,308,200, supercritical fluids are used for extracting organic substances from wood. The known methods as described in the prior art utilise the solvating qualities of supercritical carbon dioxide and have been applied to carry timber treatments (insecticides etc.) into conventionally pre-dried timber, MDF board, laminated veneers etc, or carry organic substances out of pre-dried particulated wood.

In U.S. Pat. No. 5,041,192, in particular in column 4 lines 14-18, it is briefly noted that supercritical fluids can be used for drying wood in specialty applications. A possible specialty application is the process for drying of archaeological samples developed by the University of St Andrews, Fife, Scotland that includes drying archaeological wood by substituting the water in archaeological wood with methanol and then extracting the methanol using supercritical carbon dioxide.

U.S. Pat. No. 4,995,943 describes the use of carbon dioxide under super-atmospheric pressures of several atmospheres to further pre-treat and dry particulated cellulosic material sourced from naturally (air) dried feedsocks (branches, stalks) to prepare or enhance the particulate for further chemical treatment/conversion.

Persons skilled in the art view the use and applications of supercritical carbon dioxide (as a solvent for instance) as similar or equivalent to hexane chemistry. It is therefore seen as a "dry" chemistry. As a result, the use of supercritical carbon dioxide in relation to wood has uniformly been in relation to pre-dried wood or wood wherein the water content has been substituted by an organic solvent such as methanol.

It is an object of the present invention to either provide an improved process for the removal or water and solutes from the lumens of green wood, or to provide a wood product wherein the lumens of the wood are evacuated of water and solutes while the cell walls remain in their green state and with reduced moisture gradient variation throughout the wood, or to provide an improved process for drying and/or treatment of wood or at least provide the public with a useful choice.

SUMMARY OF THE INVENTION

As used herein, the term 'air- or kiln- or oven-drying methods' and its derivatives refer to known methods of water extraction from wood, which include passive drying by air and active drying by air, either through oven- or kiln-drying, dehumidification drying and the like.

As used herein, the terms "kiln-drying" and "oven-drying" are used synonymously, to refer to drying by heated air typically accompanied by air movement via fans or similar. The term "oven-dry weight of the wood" is a term of art which refers to the weight of wood when fully dry after heated air drying whether carried out in an oven or kiln.

As used herein, the term 'green wood' refers to wood that contains a high water or moisture content. Green wood will usually consist of wood that is consistent with or similar to the material as it occurs in nature in a living state. The term includes, but is not limited to, freshly cut wood and wood that is yet to be dried. The term 'green wood' is also intended to include wood that may have undergone some moisture loss as a result of delays between harvesting and the commencement of the processes described herein or that has been subjected to a cursory procedure or treatment but that still retains a moisture content significantly greater than the moisture content at fibre saturation point. Typically green wood will have a moisture content between about 180% and 150% of the oven dry weight of the wood although this may vary depending on the type of wood and the manner in which it has been treated or handled.

As used herein 'fully swollen' refers to the condition of wood cell walls wherein they remain substantially in their green state and retaining the water bound in the cell walls.

As used herein 'uniformly fully swollen' refers to the cell walls of wood being fully swollen without substantial variation in this condition throughout different regions of the wood. The term is used to differentiate the present invention from traditional drying methods wherein some regions of a piece of wood may include fully swollen cells walls while cell walls in other regions of the wood may be to some extent desiccated.

As used herein "lumber" refers to sawn timber, typically sawn from logs, comprising wood lengths of dimensions suitable for timber framing applications e.g., 100×50 mm in cross-section, beams, and boards; all whether planed or unplaned (as opposed to timber for non-structural or finishing applications).

In a first aspect, the invention broadly consists in a process for removing water and solutes from the lumens of green wood, while leaving the cell walls throughout the wood uniformly fully swollen, by subjecting the green wood to supercritical carbon dioxide.

Preferably, the water and solutes is removed until the moisture content of the wood is about 30-80%.

Preferably, the water and solutes is removed until the wood is at or about fibre saturation point.

Preferably the carbon dioxide is applied in cycles of supercritical pressures followed by sub-critical pressures.

In a second aspect, the invention broadly consists in wood comprising uniformly fully swollen cell walls and having a moisture content of about 30-80%.

In a third aspect, the invention broadly consists in wood comprising uniformly fully swollen cell walls with lumens substantially free of water.

Preferably the lumens of the wood are free from solutes that cause or are involved in the formation of kiln stain.

In a fourth aspect, the invention broadly consists in a process for drying green wood comprising the steps of: removing the water and solutes from the lumens of the green wood using supercritical carbon dioxide to take the wood to a moisture content of about 30-80%; and further drying the wood to a moisture content of about 12-20%.

Preferably the wood is further dried using one or more of air-, azeotropic-, freeze-, electromagnetic radiation—such as radio frequency—and microwave-, or kiln-drying or additional supercritical fluid processing.

Preferably the supercritical carbon dioxide is applied on the green wood to reduce the moisture content of the green wood to about 30-60%.

In a fifth aspect, the invention broadly consists in a process for drying green wood comprising the steps of applying supercritical carbon dioxide to the green wood to remove the water, solutes from the lumens taking the wood to fibre saturation point; and further drying the wood to a moisture content of about 12-20%.

Preferably the wood is further dried using one or more of air-, azeotropic-, freeze-, electromagnetic radiation—such as radio frequency—and microwave-, or kiln-drying or additional supercritical fluid processing.

Preferably the supercritical carbon dioxide is applied in cycles.

Preferably each cycle of supercritical carbon dioxide application has a pressurisation step which is followed by a depressurisation step.

Preferably each cycle of supercritical carbon dioxide application includes a holding time step after pressurisation but before depressurisation.

Preferably the number and duration and temperature and pressures of the pressurisation and holding time and depressurisation steps of the cycles are optimised in order to maximise the rate of moisture reduction Preferably the step of air, electromagnetic radiation—such as radio frequency—and microwave-, azeotropic-, freeze- or kiln-drying the wood includes, or is followed by, keeping the wood in an environment in order to reach ambient equilibrium moisture content of about 12-20%.

Preferably the process for drying wood further comprises the step of treating the wood with modifying chemicals or materials in an aqueous or non-aqueous solution before or after air- or oven-drying.

Preferably the step of treating the wood comprises treating the wood with one or more aqueous or aqueous-compatible solutions.

Preferably the wood treated with an aqueous solution is then subject to further application of supercritical carbon dioxide to remove aqueous solution residues from lumens.

Preferably the wood treated with an aqueous solution then subjected to further application of supercritical carbon dioxide is then dried using conventional or electromagnetic radiation drying such as radio frequency and microwave drying methods to 12-20% moisture content.

In another preferred form of the invention the step of treating the wood comprises modifying chemicals or materials in a non-aqueous but water-miscible solvent.

Preferably the solvent is an organic solvent such as ethanol.

In one preferred form the modifying chemicals or materials with wood treatment qualities is boric acid in ethanol for improving wood biological durability.

Preferably after treatment using modifying chemicals or materials in a water miscible organic solvent, the wood is subject to further application of supercritical carbon dioxide until the moisture content is reduced to 12-20%.

Alternatively, after treatment using modifying chemicals or materials in a water miscible organic solvent, the wood can be conventionally dried or dried using a combination of supercritical carbon dioxide and conventional or electromagnetic radiation drying such as radio frequency and microwave drying to dry the wood to 12-20% moisture content.

In a sixth aspect, the invention broadly consists in a process for drying green wood comprising the steps of: placing the green wood into a chamber; introducing carbon dioxide into the chamber so as to form supercritical carbon dioxide within the chamber; applying the supercritical carbon dioxide on the green wood through a sequence of pressure cycles (e.g., from 72≥200 bar to 1-72 bar) at temperatures above 32° C. such that the moisture content of the green wood is reduced to about 30-80%; removing the wood from the chamber after the number of pressure cycles has been completed; and further reducing the moisture content of the wood to about 12-20%.

In a seventh aspect, the invention broadly consists in a process for drying green wood comprising the steps of: placing the green wood into a chamber; introducing carbon dioxide into the chamber so as to form supercritical carbon dioxide within the chamber; applying the supercritical carbon dioxide on the green wood through a sequence of pressure cycles (e.g., from 72≥200 bar to 1-72 bar) at temperatures above 32° C. such that the moisture content of the green wood is reduced to fibre saturation point; removing the wood from the chamber after the number of pressure cycles has been completed; and further reducing the moisture content of the wood to about 12-20%.

In an eighth aspect, the invention broadly consists in a process for drying green wood comprising the steps of: placing the green wood in a chamber, introducing supercritical carbon dioxide and carrying out a sequence of pressure cycles (e.g., from 72≥200 bar to 1-72 bar) at temperatures above 32° C. such that the moisture content of the green wood is reduced to about 30-80%; reducing the pressure of the chamber; removing the wood from the chamber; and further processing the wood such that the moisture content of the wood is reduced to about 12-20%. Preferably the supercritical carbon dioxide is applied on the green wood to reduce the moisture content of the green wood to about 40-60%.

In a ninth aspect, the invention broadly consists in a process for drying green wood comprising the steps of: placing the green wood in a chamber, introducing supercritical carbon dioxide and carrying out a sequence of pressure cycles (e.g., from 72≥200 bar to 1-72 bar) at temperatures above 32° C. such that the moisture content of the green wood is reduced to fibre saturation point; reducing the pressure of the chamber; removing the wood from the chamber; and further reducing the moisture content of the wood to about 12-20%.

Preferably the supercritical carbon dioxide is applied in fixed-duration cycles in order to maximise the rate of moisture removal. Preferably each cycle of supercritical carbon dioxide application at a particular temperature and pressure is preceded by a pressurisation step and is followed by a depressurisation step.

Preferably the pressure cycles consist of pressurisation and depressurisation steps at controlled rate.

Preferably the depressurisation step includes removing carbon dioxide from the chamber, and pumping it into a second drying chamber operating in parallel.

Preferably the step of air-, electromagnetic radiation—such as radio frequency—and microwave-, or oven-drying the wood includes, or is followed by, keeping the wood in an environment in order to reach ambient equilibrium moisture content of about 12-20%.

Preferably the process for producing dry wood material of utility value may further comprise the step of treating the wood with modifying chemicals or materials in an aqueous or non-aqueous solution before or after azeotropic-, electromagnetic radiation—such as radio frequency—and microwave-, freeze- or kiln-drying or other supercritical process.

In a tenth aspect, the invention broadly consists in a process for measuring the fibre saturation point of wood by: applying supercritical $CO_2$ treatment cycles until moisture content reduction is de minimis, weighing, kiln-drying or radio frequency-drying or microwave drying the wood till dry, reweighing and calculating the fibre saturation point.

In a eleventh aspect, the invention broadly consists in a process for drying green wood comprising the steps of: placing the green wood into a chamber; introducing carbon dioxide into the chamber so as to form supercritical carbon dioxide within the chamber; applying the supercritical carbon dioxide on the green wood through a sequence of pressure cycles (e.g., from 72≥200 bar to 1-72 bar) at temperatures above 32° C. such that the moisture content of the green wood is reduced to fibre saturation point; treating the wood with modifying chemicals in a water miscible solvent, subjecting the treated wood again to supercritical carbon dioxide and further pressure cycles until the moisture content of the wood is 12-20%.

Preferably the water miscible solvent is ethanol.

In a twelfth aspect the invention comprises a process for drying wood comprising the steps of:

removing water from the wood by subjecting the wood to supercritical carbon dioxide to reduce the wood to a moisture content in the range about 30 to about 80% of the oven dry weight of the wood; and further drying the wood to a moisture content in the range about 12 to about 20% of the oven dry weight of the wood.

In a thirteenth aspect the invention comprises a process for processing wood comprising the steps of:

removing water from the wood by subjecting the wood to supercritical carbon dioxide to reduce the wood to a moisture content in the range about 30 to 80% of the oven dry weight of the wood; and treating the wood with a liquid formulation effective to increase biological durability of physical durability of the wood.

Preferably the process comprises impregnating said liquid formulation into the wood.

The liquid formulation may be an aqueous or aqueous-compatible solution effective to increase biological durability or physical durability of the wood.

The liquid formulation may comprise one or more modifying chemicals or materials in solution comprising a non-aqueous but water-miscible solvent, effective to increase biological durability or physical durability of the wood. The solvent may be an organic solvent.

In a fourteenth aspect, the invention broadly consists in a process for drying green wood comprising the steps of: removing the water and solutes from the lumens of the green wood using supercritical carbon dioxide to take the wood to a moisture content of about 30-80%; and further drying the wood using microwave or radio frequency drying to a moisture content of about 2-12%.

In a fifteenth aspect, the invention broadly consists in a process for removing water and solutes from lignocellulosic material, while leaving the cell walls throughout the lignocellulosic material uniformly fully swollen, by subjecting the lignocellulosic material to supercritical carbon dioxide.

In a sixteenth aspect, the invention broadly consists in a process of drying wood or other lignocellulosic material having a moisture content greater than the fibre saturation point and reducing the moisture content of the wood or other lignocellulosic material to fibre saturation point using supercritical carbon dioxide.

In the process of the invention in each of its aspects above the process may include carrying out the process in less than about 24 hours or less than about 18 hours.

In the process in each of its aspects above the wood may be lumber.

Where radio frequency-drying is referred to above, in a preferred form the drying is radio frequency vacuum-drying.

The term 'comprising' as used in this specification means 'consisting at least in part of', that is to say when interpreting statements in this specification which include that term, the features, prefaced by that term in each statement, all need to be present but other features can also be present.

This invention may also be said broadly to consist in the parts, elements and features referred to or indicated in the specification of the application, individually or collectively, and any or all combinations of any two or more said parts, elements or features. Where specific integers are mentioned herein which have known equivalents in the art to which this invention relates, such known equivalents are deemed to be incorporated herein as if individually set forth.

BRIEF DESCRIPTION OF THE DRAWINGS

Preferred forms of the invention will now be described with reference to the accompanying figures in which.

DETAILED DESCRIPTION OF THE PREFERRED FORMS

The preferred form of the invention comprises a process for drying wood or drying wood to prepare the wood for modification or treatment. As noted earlier, green wood often has a high moisture content, typically up to or about 200% (of oven-dry weight). For improving the properties and the commercial value of the wood, it is known to skilled persons that the moisture content should be reduced to around 12-20%.

The process of the present invention includes the removal of water and solutes from the lumens of wood typically green wood using supercritical carbon dioxide or $CO_2$. The critical temperature of carbon dioxide is 31.1° C. and the critical pressure of carbon dioxide is 72.8 atm or 7.27 MPa. Provided the carbon dioxide is subjected to a temperature and pressure over these critical values, the carbon dioxide may be made to flow in a supercritical state.

Supercritical carbon dioxide extracts water from the wood based on the theory of physical-chemical removal of water. Carbon dioxide dissolves in water over a range of temperatures and pressures in accordance with Henry's Law. Carbon dioxide also undergoes chemical reaction with water to form carbonic acid, bicarbonate and carbonate anions. When carbon dioxide reacts with water, an equilibrium mixture of carbonic acid, bicarbonate and carbonate anions is formed as shown in the equation below:

$$CO_2+H_2O \leftrightarrows H_2CO_3 \leftrightarrows H^+ + HCO_3^- \leftrightarrows H^+ + CO_3^-$$

Figure 1:
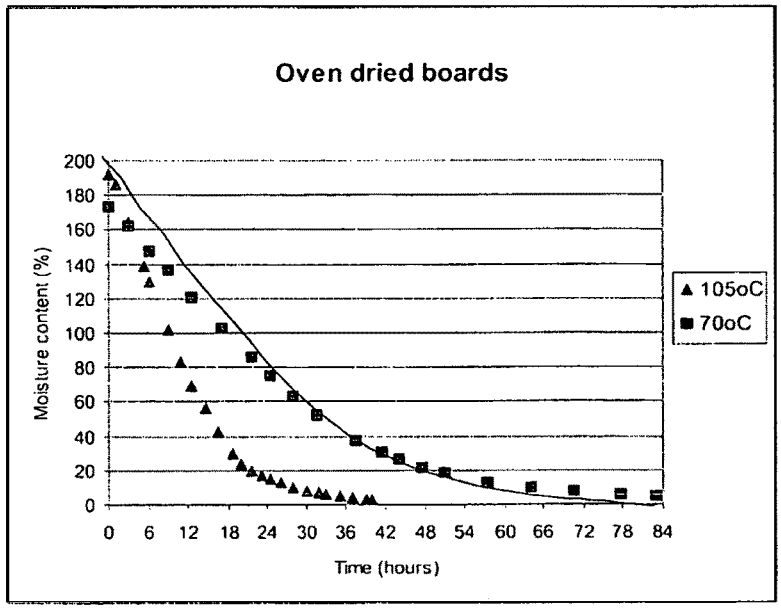
FIG. 1 is a graph showing the reduction of green wood moisture content through oven-drying, the green wood material being sapwood of *Pinus radiata* D. Don (a representative softwood species)
Figure 2:
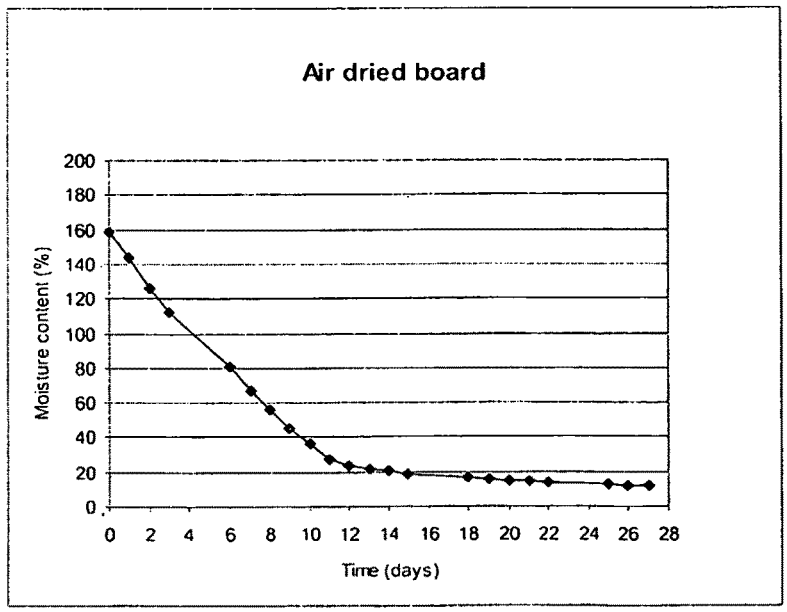
FIG. 2 is a graph showing the reduction of green wood moisture content through air-drying, the green wood material being sapwood of *P. radiata;*
Figure 3:
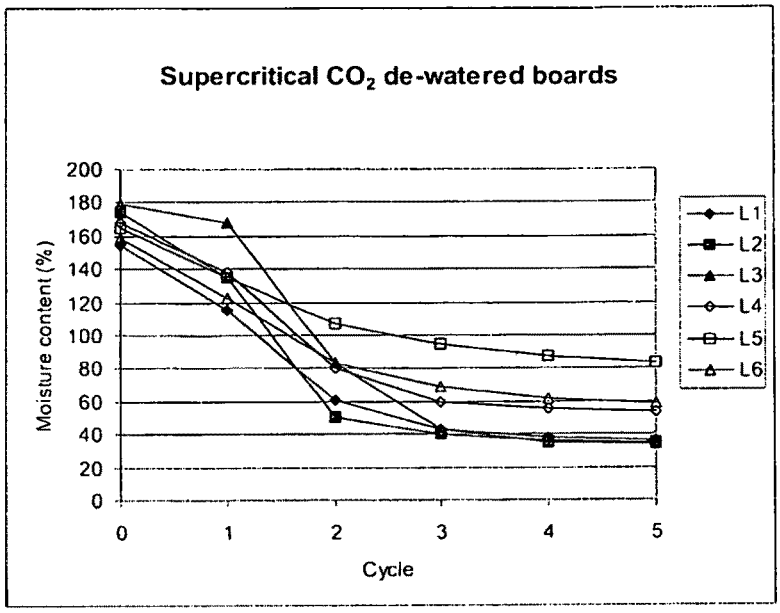
FIG. 3 is a graph showing the reduction of green wood moisture content through supercritical carbon dioxide dewatering the green wood material being sapwood of *P. radiata;*

Given the properties of supercritical fluids, and the chemical equilibrium of carbon dioxide and water, the supercritical carbon dioxide is able to extract water from the green wood at a much faster rate than conventional drying processes, by manipulating the chemical equilibria shown above by application of the Le Chatelier Principle. A comparison of the water extraction rate of oven- and air-drying, and the extraction rate of supercritical carbon dioxide is shown in FIGS. 1 to 3.

It also extracts the water in a manner that is far more uniform throughout the volume of the wood than do conventional drying methods which result in certain areas drying more quickly and to a greater extent than other areas.

Cell walls are known to reduce in strength and flexibility and vary in dimension once the water bound in the cell walls begins to be extracted in drying processes. When the cell walls in some regions of a piece of wood dry faster than other neighbouring areas, as often occurs using conventional drying methods, the associated changes in dimension and strength increase the likelihood of distortion and damage to the wood. The rates at which cell walls dehydrate in conventional drying processes is dependent not only on where in a particular piece of wood the cell wall is but also on the moisture content in regions neighbouring the cell wall. A significant factor is the moisture content in the lumen of the cell and surrounding cells.

The present invention provides a means to dry wood that includes a means of removing the free water from lumens in a more uniform and faster manner throughout wood than can be provided by most conventional drying methods. Further this can be affected while leaving the cell walls is a fully swollen green state. This not only makes the cell walls more amenable to treatment, due to being in a green state and at least initially having the cell wall pits remain open, but also has the consequence of proving a more uniform environment for cell walls when further drying to below fibre saturation point occurs. This in turn reduces the moisture gradient when compared to kiln drying differential throughout the wood during further drying and so reduces the likelihood of damage and distortion to the wood and improves the yield of wood with utility value. Certain chemical treatments that can be applied at fibre saturation point with cell walls substantially and uniformly in fully swollen state, the uptake of which is generally better through use of the present process, can further increase the physical or biological durability of the wood and the wood's cell walls reducing further the likelihood of damage and further improving yields.

For the purposes of this specification, increased "durability" may mean increased strength, stiffness, hardness, flexibility, density, dimensional stability, resistance to distortion or degradation or any combination of these.

FIG. 1 shows the reduction of moisture content in *P. radiata* green sapwood through oven-drying. Two plots are shown—one with the oven operating at 70° C. and the other with the oven operating at 105° C. Under a 70° C. oven-drying process, a green sapwood board (approximately 100 mm width, 50 mm thickness) with a moisture content of 174% took 23 hours to reach 80% moisture content and 37 hours to reach 40% moisture content. Under a 105° C. oven-drying process, a similar green sapwood board with a moisture content of 192% took 11 hours to reach 80% moisture content and 17 hours to reach 40% moisture content.

FIG. 2 shows the reduction of moisture content in a similar green sapwood board through air-drying. It can be seen that the sapwood board with a moisture content of 159% took 6 days to reach 80% moisture content and 9.5 days to reach 40% moisture content.

FIG. 3 shows the reduction of moisture content of similar green sapwood boards through the use of supercritical $CO_2$. In the plots shown, five-minute pressure cycles of supercritical $CO_2$ were applied on the green wood at a pressure of 200 atm and at a temperature of 45° C. It can be seen that the moisture content of the green wood can be rapidly reduced from around 150-180% to about 40-80% in as little as two to five cycles, or 10 to 25 minutes holding time, or 1-3 hours including the supercritical fluid establishment (pressurisation) and reduction and/or release (de-pressurisation) times.

Figure 4:
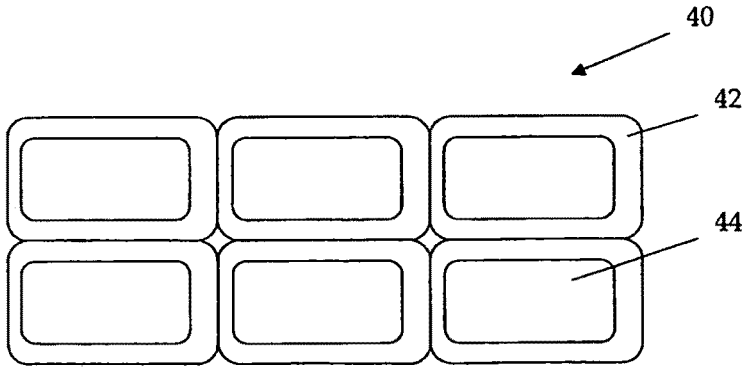
FIG. 4 is a schematic showing the cell structure in green wood.

The use of supercritical $CO_2$ to remove water and solutes from the wood down to 30-80% moisture content also has the benefit of retaining the wood's cell wall structure in its green state. A schematic of the green wood structure is shown generally as 40 in FIG. 4. Water in the green wood is found in cell walls 42 and cell lumens 44. Water in the cell lumens 44 can be removed using the supercritical carbon dioxide processes described herein without removing the water bound to the cell walls and thus without affecting the wood's cell wall structure.

The wood remains in its green state as indicated by the wood cell wall hydration and porosity. This has advantages in the treatment of the wood to modify its properties. At or close to fibre saturation point the wood can be treated with aqueous solutions (or non-aqueous solutions in which solvents have some compatibility with water, such as ethanol) of chemicals which can be used for modifying wood material, such as, but not limited to, biocides for imparting durability to the wood or monomers, oligomers or polymers for modifying wood mechanical and engineering properties, such as modulus of elasticity, density and hardness. Such solutions, as residual after exchange of chemicals between solutions in lumens and moisture in cell walls, can also be subsequently removed from the wood using supercritical fluid dewatering to deliver modifying chemicals into wood cell walls without residues in cell lumens. Wood material dewatered, modified, and subsequently dewatered can the be readily finally dried by conventional means to give natural or modified wood material of utility value but with enhanced properties such as, but not limited to, durability, stability and stiffness.

Wood treated with wood modifying materials in water miscible organic solvents such as ethanol can be dried to 12-20% moisture content without using conventional drying processes but using only applications of supercritical carbon dioxide, with the wood modifying materials and ethanol supplanting the bound water in the cell walls followed by extraction of the ethanol by the supercritical carbon dioxide.

Significant removal of water from the cell walls 42 can result in undesirable changes to the wood structure, such as dimensional changes, shrinking and distortion of the wood. In addition, such removal of water from the cell walls can adversely affect subsequent modification of the wood chemical content and physical structure by application of chemicals such as, for example, boric acid, borate salts and wood hardening formulations. As will be detailed later, the removal of water from the cell walls by air-, or oven-drying or other methods can adversely affect uptake of aqueous solutions during any subsequent wood treatment or modification process. It is therefore desirable to remove the water from the cell lumen and yet substantially retain the water in the cell wall. The point at which all cell lumen water has been expelled and only cell wall water remains is called the fibre saturation point (FSP), which is typically about 30-60% moisture content for a softwood such as radiata pine.

It has been found that the use of supercritical $CO_2$ for dewatering the wood to 30-80% moisture content results in a wood material with cell lumen water removed while cell walls remain fully swollen and in the green wood state. The use of supercritical $CO_2$ is therefore not only beneficial for its rapidity in moisture reduction but also for its ability to do so without adversely affecting the green wood structure. Further because of the rapidity of moisture reduction from the lumens the sap and other solutes in lumen water is removed faster than the reactions that cause kiln stain can occur meaning the finished product is free of kiln stain. Further because of the rapidity and the maintaining of cell walls in a green state the pores in the cell walls are not closed, at least not immediately, as occurs during conventional drying processes.

Referring to FIG. 3, once the wood reaches a moisture content of about 40-80%, which is at, around or just above the fibre saturation point, further reductions of moisture content using supercritical $CO_2$ do not occur with the rapidity as compared with the reduction from 150-180% to around 40-80% moisture content. In fact the further drying that is shown in some of the experimental results is at a rate that is difficult to distinguish from, and is likely to be primarily due to drying resulting from, exposure to the ambient conditions (i.e. conventional drying) during testing rather than by the action of supercritical carbon dioxide.

It is, however, generally necessary to further reduce the equilibrium moisture content of the wood to about 12-20% for commercial uses. For this reason, the supercritical $CO_2$ process may be augmented with conventional (air, oven- or other including supercritical fluids) drying methods once the wood moisture content has been reduced to about 40-80%. Most preferably, the supercritical $CO_2$ process is augmented with conventional methods once the wood has approached 40-60% moisture content. Although any conventional drying technique can be used after the supercritical $CO_2$ process, preferably either air-drying or kiln-drying or RFV-drying is used.

In another form of the invention the wood having been subjected to supercritical $CO_2$ cycles to reduce the wood to a moisture content of 40-80% may be soaked in a water miscible organic solvent such as ethanol and optionally a treatment agent such as boric acid. The ethanol not only carries the treatment agent into the cell walls but also substitutes water bound in the cell walls. Further processing by way of supercritical carbon dioxide cycles removes ethanol and allows the moisture content of the wood to be reduced to 8-20%.

As stated above, the supercritical $CO_2$ process stops (or at least significantly slows to insignificant rates) extracting water at fibre saturation point. Fibre saturation point averages as recorded in known scientific literature tend to be slightly lower than moisture content percentages reached using the supercritical $CO_2$ process. Fibre saturation points recorded in the literature may be lower than the true fibre saturation point due to the drying methods adopted when making such measurements. Conventional drying methods that result in all the free lumen water being removed also result in at least the partial and varied dehydration of cell walls in at least some parts of the wood. Although the fibre may be saturated in some or even most cell walls in a given piece of wood, other cell walls have given up their bound water and as a result measurement of fibre saturation point using wood dried by conventional means results in fibre saturation point data slightly lower than the possible true saturation point. Further because conventional drying processes continuously remove moisture at a relatively consistent rate (i.e. they do not stop at fibre saturation point as does supercritical CO2 drying) there is an element of subjectivity and human error in deciding when a piece of wood has reached such a point and should be weighed. In contrast, the supercritical $CO_2$ process results in wood that uniformly maintains fully swollen cell walls (as evidenced by analysis of the specific density of cell wall samples taken from different locations of the wood) and dry lumens (evidenced by NMR imaging) and irrespective of the application of further cycles, further moisture loss is substantially restricted to an extent that it is indistinguishable from drying that occurs due to exposure to atmospheric conditions during weighing of samples for the purpose of data gathering. There is a clear gradient shift in the rate of moisture loss indicating that the drying process due to supercritical carbon dioxide application stops at (or very close to) the fibre saturation point of the particular piece of wood.

Although the cessation of drying at fibre saturation point may be seen as a disadvantage if the objective is to dry the wood to 8-20% moisture content, there are also substantial benefits. Not only does it allow retention of cell wall structural integrity and thus reduce the likelihood of deformation but as referred to earlier, the benefit of retaining water in the cell walls and thus the green wood structure after dewatering using supercritical $CO_2$ is that the dewatered wood is more susceptible to the uptake of certain aqueous solutions at a subsequent stage for modification of the wood chemical content or physical structure. For instance, it has been shown to treat dewatered wood with chemical solutions to improve wood properties, such as biological and physical durability. It has been found that the retention of the green structure in the wood held at fibre saturation point greatly improves and facilitates a number of subsequent treatment processes, for instance where the wood is simply immersed in a treatment solution. Non-limiting examples of treatment solutions include boric acid and borate salts for improving wood biological durability and wood hardening or modifying formulations such as Indurite™ for improving wood physical durability.

In addition to the supercritical $CO_2$ process being faster and affording improved wood structure, the supercritical $CO_2$ process also avoids the disadvantage of kiln stain. As noted earlier, kiln stains are undesirable dark-coloured regions that are formed on or just under the surface of the wood during kiln-drying. This stain detracts from wood quality especially for appearance in products such as furniture. After the supercritical $CO_2$ process, the wood that now has much reduced moisture content but remains green in terms of its cell walls was found to be pale in colour with no evidence of kiln stain.

In addition to the supercritical $CO_2$ process being faster and affording improved proved dewatered wood structure and consequently wood material quality, the supercritical $CO_2$ dewatering process also avoids the disadvantage of toxic aerial emissions, such as those containing methanol, formaldehyde, acetaldehyde, furfuraldehyde which can occur during the drying of green wood using the kiln-drying process.

In the commercial process of kiln-drying where the moisture in the green wood is lost as steam, and, depending on kiln temperature and other factors, components of the wood undergo hydrolysis and thermolysis chemical reactions to yield small molecules such as formaldehyde, acetaldehyde, acetic acid and guiacol, and these small molecules can also be carried in the steam; the consequence can be environmental contamination from these small molecules. In contrast, the process of application of supercritical carbon dioxide to green wood allows for collection of the water and solutes in liquid state in a container and disposal of the water through a sewage process or alternatively, recovery of the natural compounds in the wood moisture.

Process of Supercritical Carbon Dioxide Application

Figure 5:
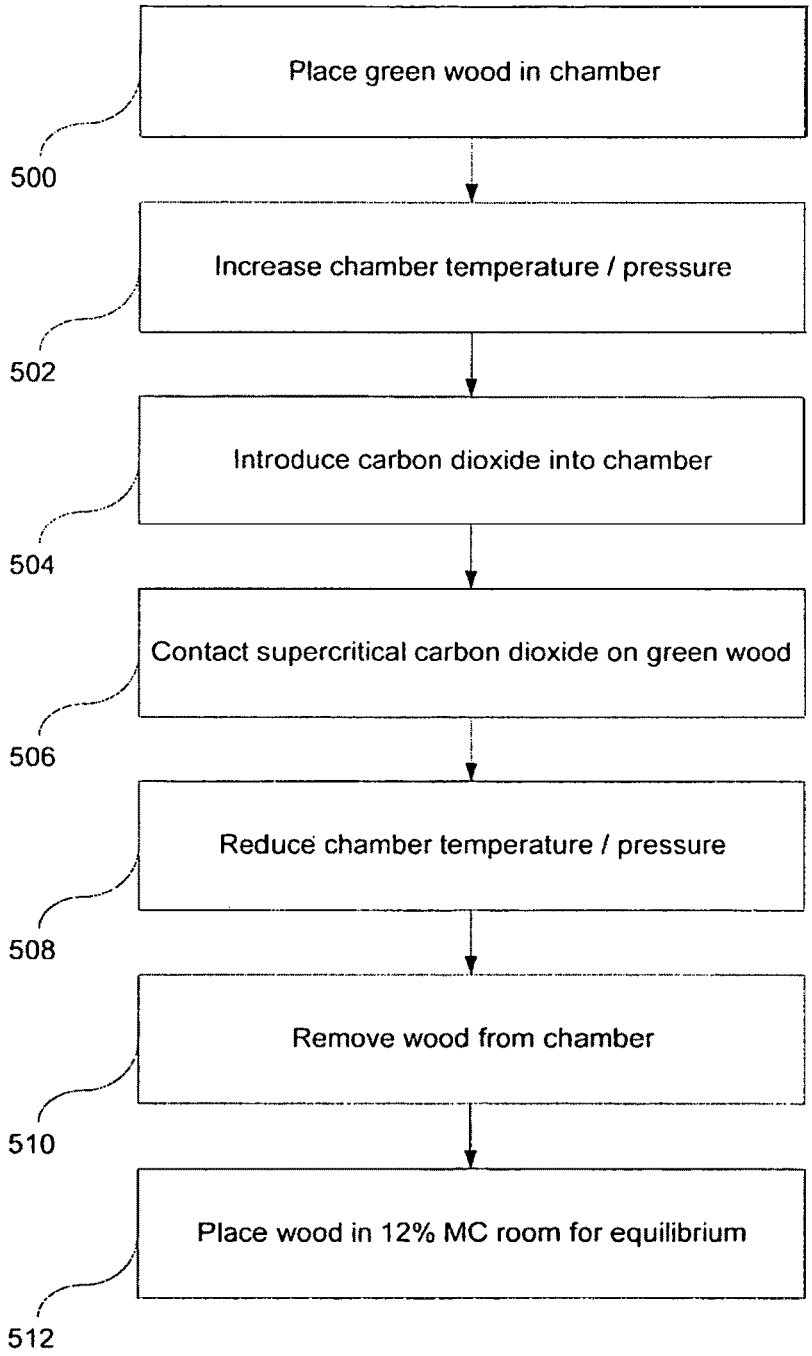
FIG. 5 is a flow chart of one example process of the invention.

One example process of the present invention will now be described with reference to the flow chart of FIG. 5. The process begins with the placement of green wood into a chamber for removal of water and solutes from the lumens in step 500. The chamber is designed to withstand temperature and pressure levels required for the carbon dioxide to reach a supercritical state for processing the green wood.

Once the green wood is placed in the chamber, the temperature is increased in step 502 then carbon dioxide is introduced in step 504 and the pressure of the chamber is increased. The temperature and pressure increase in steps 502 and 504 should be such that the environment in the chamber exceeds the critical temperature and critical pressure of the carbon dioxide that will be used for the supercritical carbon dioxide dewatering process. Step 502 may alternatively be incorporated into step 500, where the green wood is placed into a preheated chamber. For the maintenance of the chamber temperature in practice, the temperature may be kept at or above that of the critical point of carbon dioxide. It is also envisaged that the carbon dioxide would be heated to a temperature above the critical temperature before it is introduced into the chamber and the carbon dioxide pressure increased to above the critical pressure. In this case, it may not be necessary to increase the temperature in the chamber (or preheat the chamber), and a pressurisation step may be all that is required to reach a supercritical state. For carbon dioxide to enter a supercritical state, the temperature of the chamber and the carbon dioxide within the chamber should be over 31.1° C. and the pressure in the chamber should be higher than 72.8 atm.

The supercritical carbon dioxide is then applied to the green wood in a sequence of steps so that the pressure of the carbon dioxide is cycled between a pressure greater than 72.8 atmospheres (e.g., 200 bar) and a pressure less than 72.8 atmospheres (e.g., 50 bar) such that the moisture content of the green wood is reduced to about 40-80% moisture content, as indicated in step 506. Step 506 may alternatively be incorporated into step 504, where, as soon as the carbon dioxide is introduced into the chamber, supercritical carbon dioxide is formed and applied to the green wood.

Once the moisture content of the wood reaches the range of 30-80%, the pressure (and optionally, the temperature) in the chamber are reduced, in step 508 to allow removal of the wood at fibre-saturation point from the chamber. Where only the pressure of the chamber was increased in the pressurisation step, all that is required is a depressurisation step. Preferably, the pressure (and optionally, the temperature) in the chamber are reduced once the wood moisture content reaches about 40-60%. The temperature may be reduced to room temperature, and the pressure may be reduced to atmospheric pressure. The wood is then removed from the chamber and may be either further processed or chemically modified in order to enhance biological and/or physical durability, in step 510 and/or air- or oven- or RFV-dried and subsequently equilibrated to about 8-20% moisture content, in step 512. Optionally, the green wood material may be de-watered to fibre saturation point, and any further process such as chemical modification, may be carried out in the same chamber as the dewatering step, provided that the design and engineering of the chamber has allowed for introduction of wood modifying chemical solutions in addition to the supercritical carbon dioxide dewatering process.

Figure 6:
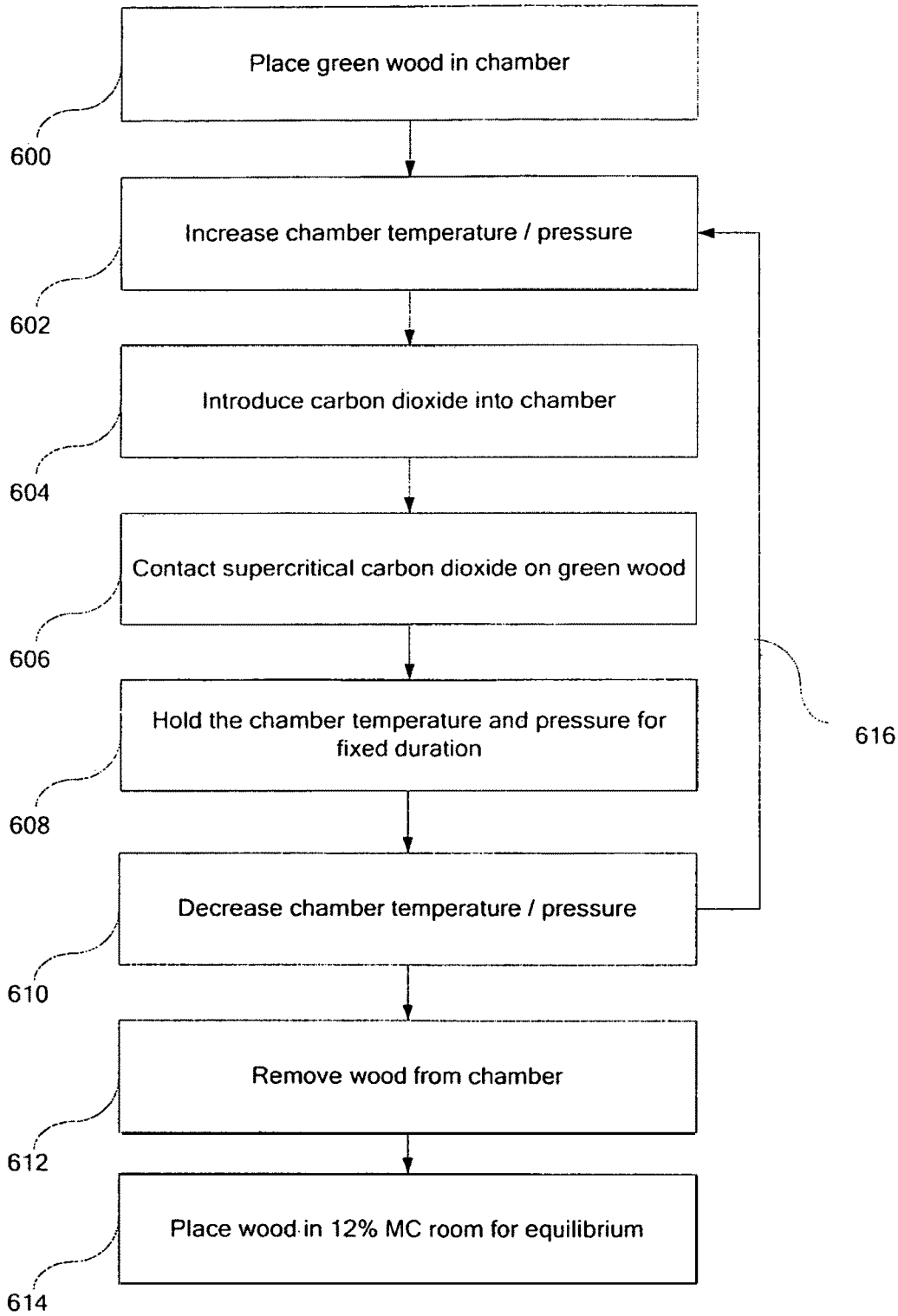
FIG. 6 is a flow chart of another example process of the invention.
Figure 7:
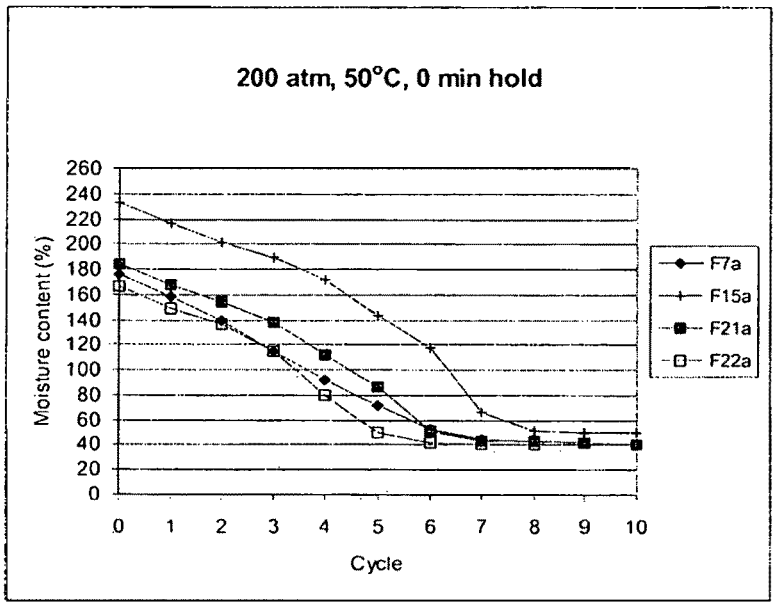
FIG. 7 is a graph showing the reduction of *P. radiata* green sapwood moisture content through supercritical carbon dioxide dewatering at 200 atm, 50° C. and with no time interval between the establishment of the supercritical fluid and its release through reduction in pressure to atmospheric pressure.
Figure 8:
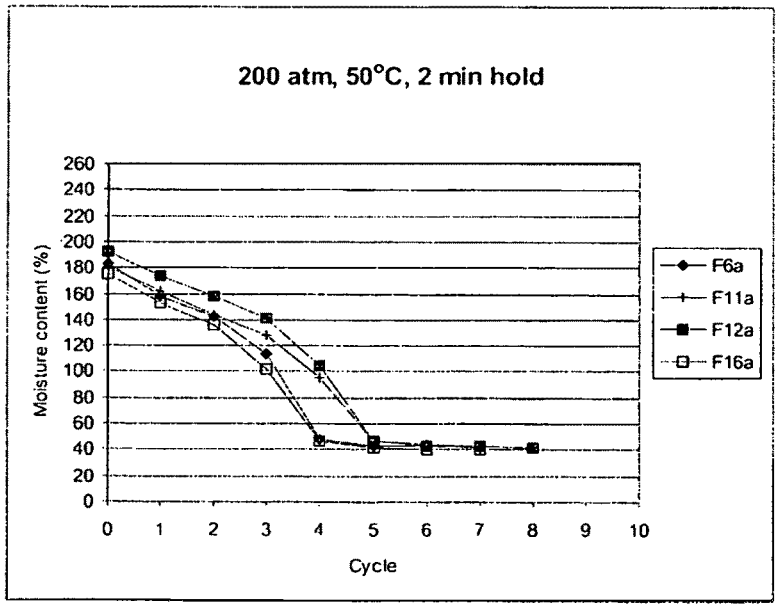
FIG. 8 is a graph showing the reduction of *P. radiata* green sapwood moisture content through supercritical carbon dioxide at 200 atm, 50° C. and with a 2-minute interval between the establishment of the supercritical fluid and its release, this time interval being defined as the 'holding time'.
Figure 9:
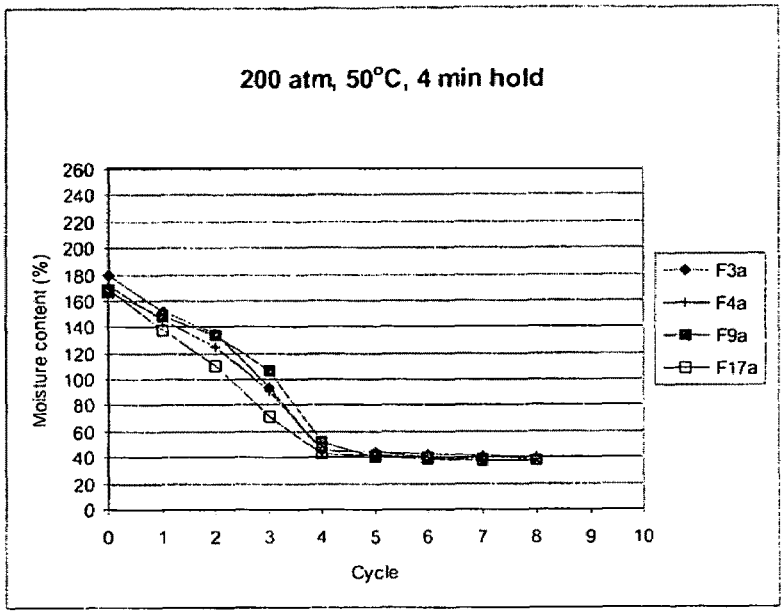
FIG. 9 is a graph showing the reduction of *P. radiata* green sapwood moisture content through supercritical carbon dioxide at 200 atm, 50° C. and with a 4-minute holding time.
Figure 10:
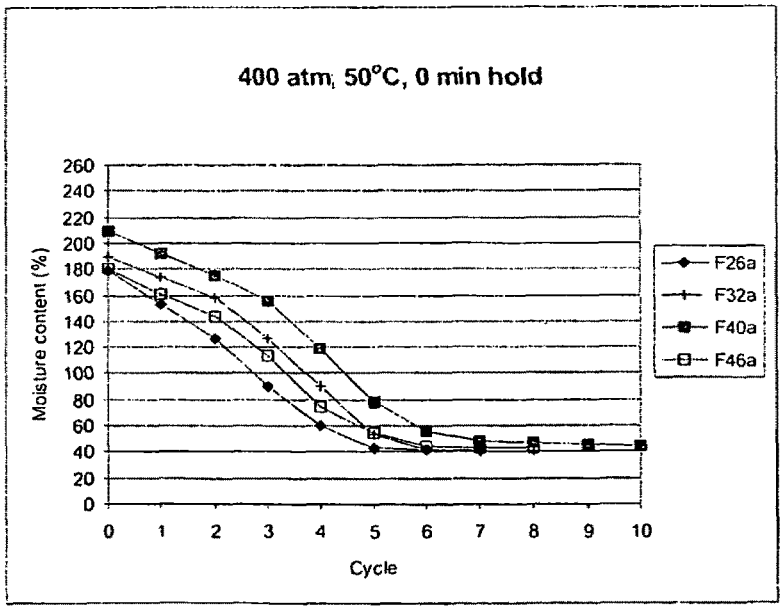
FIG. 10 is a graph showing the reduction of *P. radiata* green sapwood moisture content through supercritical carbon dioxide at 400 atm, 50° C. and with zero holding time.
Figure 11:
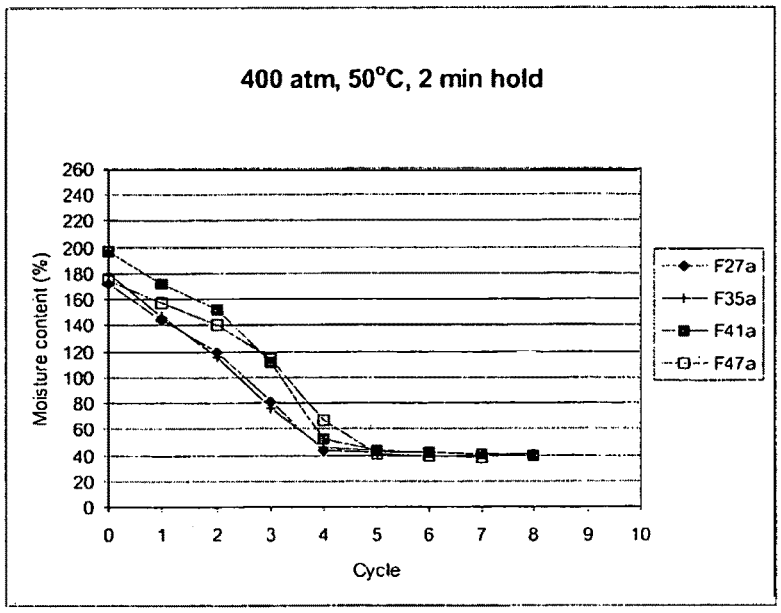
FIG. 11 is a graph showing the reduction of *P. radiata* green sapwood moisture content through supercritical carbon dioxide at 400 atm, 50° C. and with a 2-minute holding time.
Figure 12:
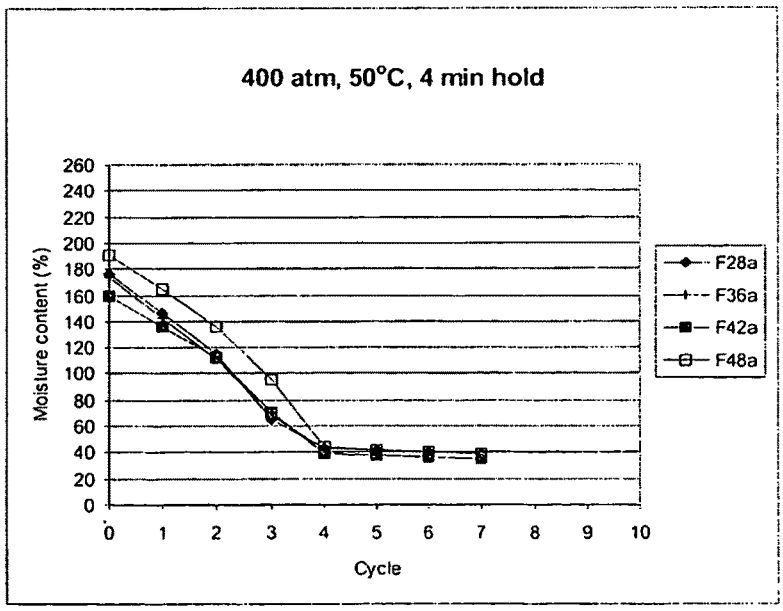
FIG. 12 is a graph showing the reduction of *P. radiata* green sapwood moisture content through supercritical carbon dioxide at 400 atm, 50° C. and with a 4-minute holding time.
Figure 13:
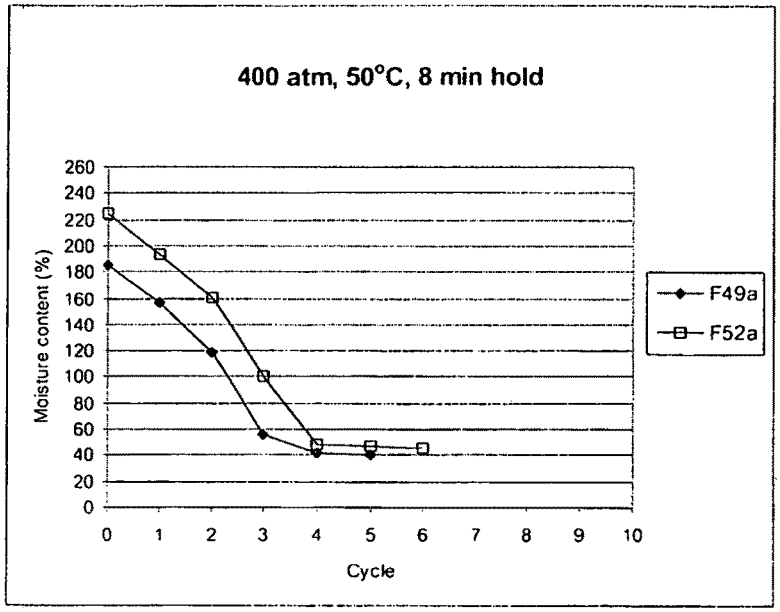
FIG. 13 is a graph showing the reduction of *P. radiata* green sapwood moisture content through supercritical carbon dioxide at 400 atm, 50° C. and with an 8-minute holding time.
Figure 14:
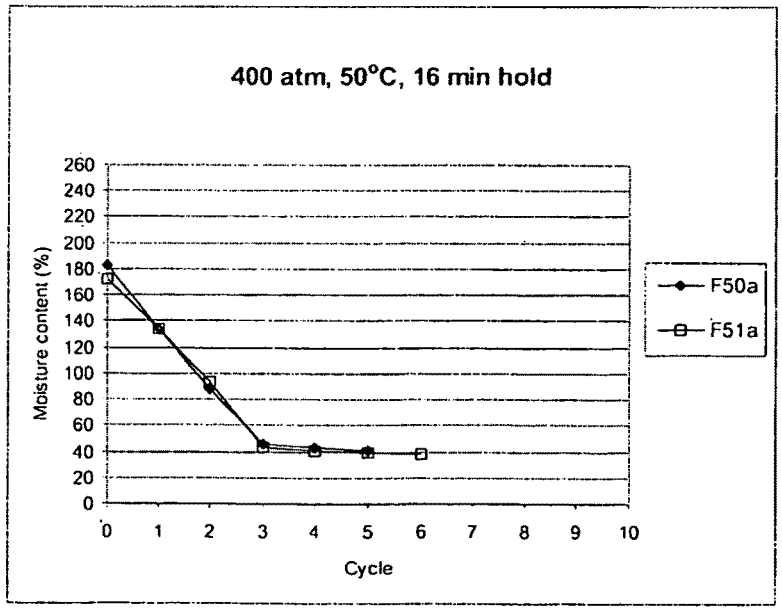
FIG. 14 is a graph showing the reduction of *P. radiata* green sapwood moisture content through supercritical carbon dioxide at 400 atm, 50° C. and with a 16-minute holding time.
Figure 23:
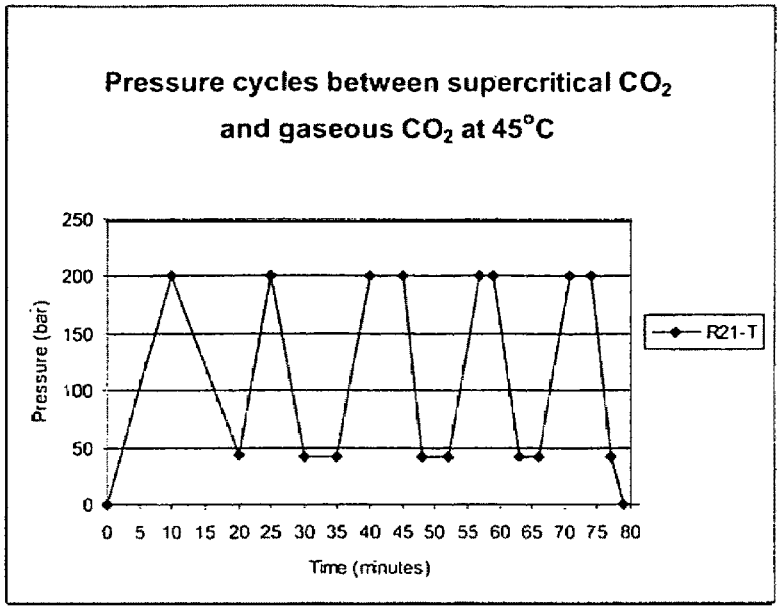
FIG. 23 is a graph showing the pressure cycles (and times) between using supercritical CO2, 200 bar and gaseous CO2 at 45° C. and 42 bar and at 45° C. to cause the supercritical CO2 process to occur for dewatering green radiata pine sapwood wood (100×50×1400 mm) to fibre saturation point, about 40% moisture content. The board specimen weighed 7.36 kg green, 3.69 kg at fibre saturation point with recovery of 3.95 kg of wood sap water.

Another example process is shown in FIG. 6. This process also begins with the placement of green wood into a chamber, as shown in step 600. In step 602, the temperature is increased then carbon dioxide is introduced in step 604 and the pressure of the chamber is increased. The temperature and pressure increase in steps 602 and 604 should be such that the environment in the chamber exceeds the critical temperature and critical pressure of the carbon dioxide that will be used for the supercritical carbon dioxide processing. Step 602 may alternatively be incorporated into step 600, where the green wood is placed into a preheated chamber. For the maintenance of the chamber temperature in practice, the temperature may be kept at or above that of the critical point of carbon dioxide. As described earlier with reference to FIG. 5, the chamber temperature may not need to be increased if the carbon dioxide is heated prior to introduction into the chamber. In step 606, supercritical carbon dioxide is applied to the green wood. The processes in steps 602 through to 606 are continued for a fixed period, which may be a predetermined holding time, in step 608. Once step 608 is completed, the pressure (and optionally the temperature) of the chamber are reduced in step 610. Provided the moisture content has been adequately reduced, that is to around 40-80% moisture content, the process may proceed to step 612, where the wood is removed from the chamber. Once removed, the wood may be either, chemically modified in order to enhance biological and/or physical durability, in step 614 and/or air- or oven-dried and subsequently equilibrated to about 8-20% moisture content, in step 616.

Where the moisture content has not been adequately reduced after step 610, the process returns to step 602 (or optionally, 604), as shown in the figure via arrow 616, where the pressurisation, supercritical carbon dioxide application and depressurisation steps are repeated, as depicted in FIG. 23. The processes between steps 602 (or optionally, 604) and 610 inclusive may be repeated as necessary, by measuring the moisture content at the end of step 610, or alternatively, the process may be repeated a predetermined number of times based on previous estimations to achieve a wood moisture content of about 40-80%. Once this level of moisture content is achieved, the wood is then removed from the chamber (as depicted in FIG. 23) and may be either chemically modified in order to enhance biological and/or physical durability, in step 614 and/or air-, or oven-dried and subsequently equilibrated to about 8-20% moisture content, in step 616.

By exploiting the green nature or state of the wood cell walls and their moisture content at or just above the fibre saturation point at the end of the supercritical carbon dioxide dewatering process, the wood material obtained, at 30-80% moisture content, may be treated with a variety of aqueous chemical formulations, such as, but not limited to, those containing chemicals, such as boric acid, Indurite™ formulation for biological and physical durability enhancements.

Furthermore, by exploiting the green nature or state of the wood cell walls and their moisture content at or just above the fibre saturation point at the end of the supercritical carbon dioxide dewatering process, the wood material obtained, at 30-80% moisture content, may be treated with non-aqueous chemical formulations in which solvents are miscible with water, such as low molecular weight alcohols, such as ethanol or propan-2-ol.

Examples of the aqueous solutions include boric acid and borate salts for improving wood biological durability and wood hardening solutions for improving wood physical durability. An example of a non-aqueous solution includes boric acid dissolved in ethanol for improving wood biological durability.

A further non-limiting example includes a wood treating chemical carried by a water incompatible solvent such as hexane wherein that solvent is formulated with surfactants and/or emulsifiers.

Furthermore, by exploiting the green nature or state of the wood cell walls and their moisture content at or just above the fibre saturation point at the end of the supercritical carbon dioxide dewatering process, the wood material obtained, at 30-80% moisture content, may be treated with chemicals and chemical formulations which are delivered to wood material using supercritical carbon dioxide as described in U.S. Pat. No. 6,638,574.

A further application is the reduction of moisture content to 30-80% or to fibre saturation point using supercritical carbon dioxide then further drying the wood using electromagnetic radiation drying such as microwave or radio-frequency drying.

Electromagnetic radiation drying removes water by exploiting the excitation of the dielectric water molecules while leaving the wood polymer in a predominantly un-activated state. The excitation of the water molecules causes the breaking of the network of hydrogen bonds that bind the water molecules to the wood and to each other allowing evaporation of the water molecules. This drying method is most efficient at fibre saturation point and below until the water content becomes so low that there is no more excitation and the wood starts to cool. As a result the combination of drying to or about fibre saturation point using supercritical carbon dioxide is ideally complementary to drying with electromagnetic radiation such as radio frequency or microwave drying.

Using such methods i.e. supercritical carbon dioxide followed by electromagnetic radiation dewatering, moisture content can be reduced from fibre saturation point to 2-12% in minutes with the resulting wood product particularly when it has a moisture content in the lower part of that range being suitable for treatment or modification with hydrophobic compositions.

The process of the invention is further illustrated by the following four examples, in which Example 1 relates to the use of the invention to dry green *P. radiata* sapwood (a softwood) and Example 2 relates to the use of the invention to dewater green *E. nitens* sapwood (a hardwood). Example 3 relates to the use of the invention to dewater radiata pine sapwood and treat the dewatered wood with boric acid solution to modify the wood's biological durability. Example 4 relates to the use of the invention to dewater *P. radiata* sapwood using supercritical carbon dioxide followed by electromagnetic drying, in the example using microwaves.

Example 1

Green *P. radiata* sapwood was cut into pieces (8 mm×8 mm×140 mm). Each green wood piece was weighed and then placed in a laboratory high-pressure chamber and subjected to the supercritical carbon dioxide process. Typically, it required 1 minute to either pressurise or depressurise the vessel. Holding times ranged from 0 minutes to 16 minutes. An outlet valve was attached to the end of the vessel to allow rapid depressurisation after the allocated holding time.

At the completion of the process, all wood samples were placed in a 12% moisture content room to reach equilibrium. Weights and dimensions were recorded and the moisture contents were calculated using a predicted oven dry value.

The results from the process are shown in FIGS. 7-14. Table 1 below shows the total time taken to reach an average moisture content between 40% and 46% using the supercritical $CO_2$ dewatering process.

TABLE 1

| Pressure (atm) | Temperature (°) | Hold time (min) | Number of cycles | Total run time (min) | Average moisture content (%) |
|---|---|---|---|---|---|
| 200 | 50 | 0 | 8 | 16 | 45 |
| 200 | 50 | 2 | 6 | 24 | 43 |
| 200 | 50 | 4 | 6 | 36 | 41 |
| 400 | 50 | 0 | 7 | 14 | 44 |
| 400 | 50 | 2 | 5 | 20 | 42 |
| 400 | 50 | 4 | 4 | 24 | 42 |
| 400 | 50 | 8 | 4 | 40 | 45 |
| 400 | 50 | 16 | 3 | 54 | 45 |

Example 2

Sawn timber from *E. nitens* is problematic to dry successfully. Both flat-sawn and quarter-sawn *E. nitens* boards undergo checking, distortion and collapse during drying. It has been found to be essential for eucalyptus species to be carefully air dried.

Small-scale (8 mm×8 mm×140 mm) green *E. nitens* sapwood and heartwood samples were dewatered using supercritical $CO_2$ to demonstrate the advantage of the process for producing dry wood free of distortion.

Wood pieces were weighed, then dewatered using supercritical $CO_2$ in multiple 2-minute cycles at 50° C. and either 200 atm or 400 atm. At the completion of the process, all wood samples were placed in a 12% moisture content room to reach equilibrium. Weights were recorded and the moisture contents were calculated using a predicted oven dry value. The results are shown plotted in FIGS. 15-18. In comparison, the results of air drying are shown in FIGS. 19 and 20.

Figure 15:
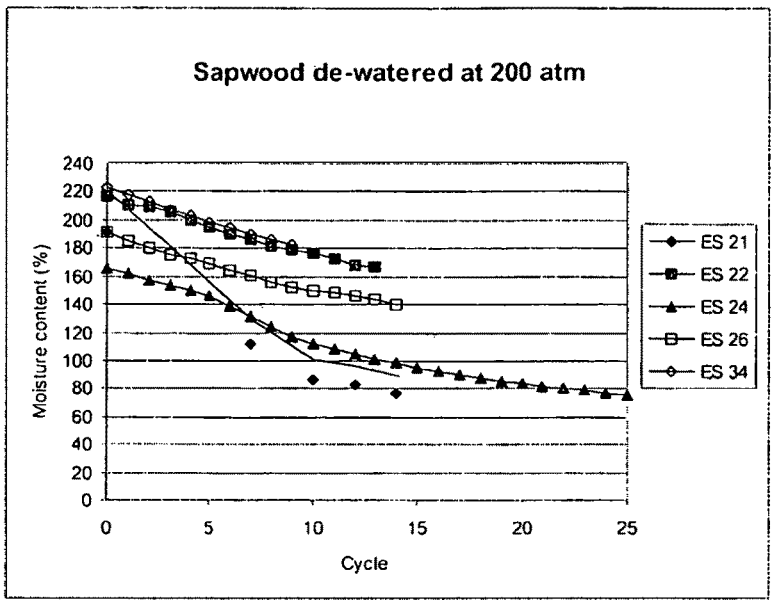
FIG. 15 is a graph showing the reduction of *Eucalyptus nitens* (H. Deane & Maiden) Maiden (a representative hardwood species) green sapwood moisture content through supercritical carbon dioxide at 200 atm, 50° C. and with a 2-minute holding time.
Figure 16:
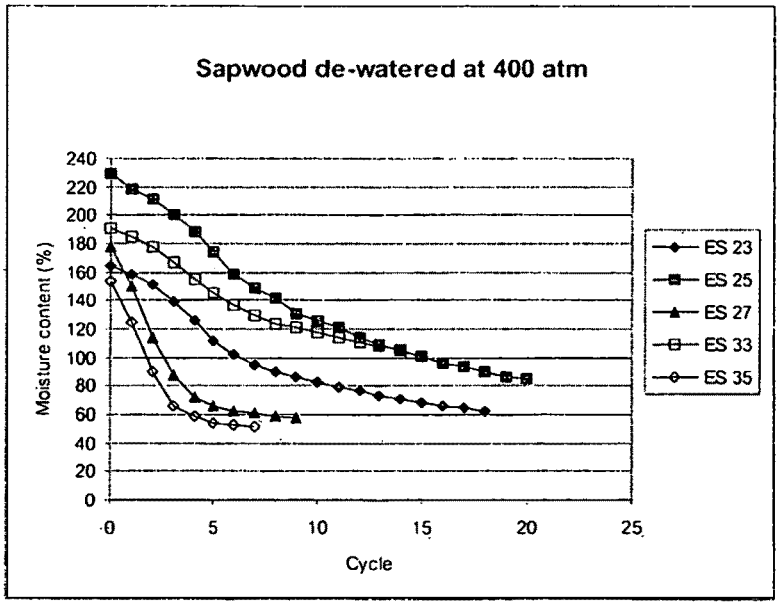
FIG. 16 is a graph showing the reduction of *E. nitens* green sapwood moisture content through supercritical carbon dioxide at 400 atm, 50° C. and with a 2-minute holding time.
Figure 17:
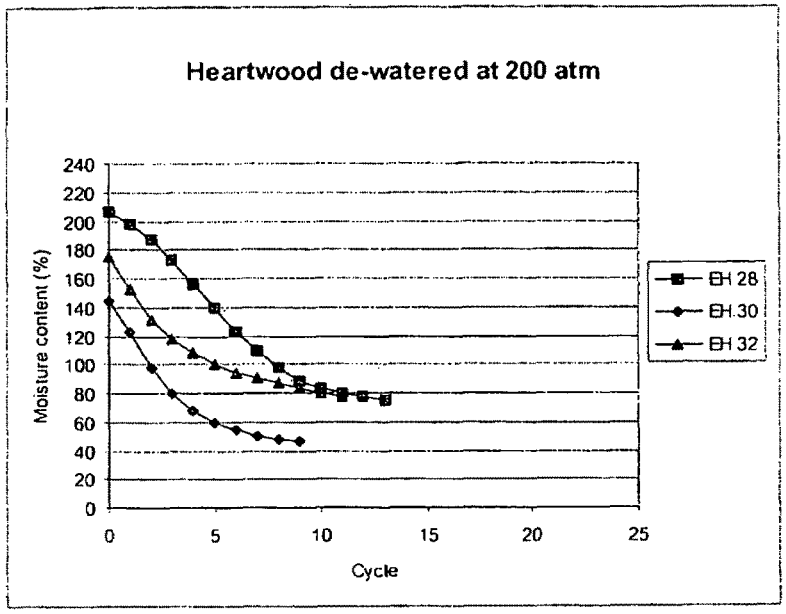
FIG. 17 is a graph showing the reduction of *E. nitens* green heartwood moisture content through supercritical carbon dioxide at 200 atm, 50° C. and with a 2-minute holding time.
Figure 18:
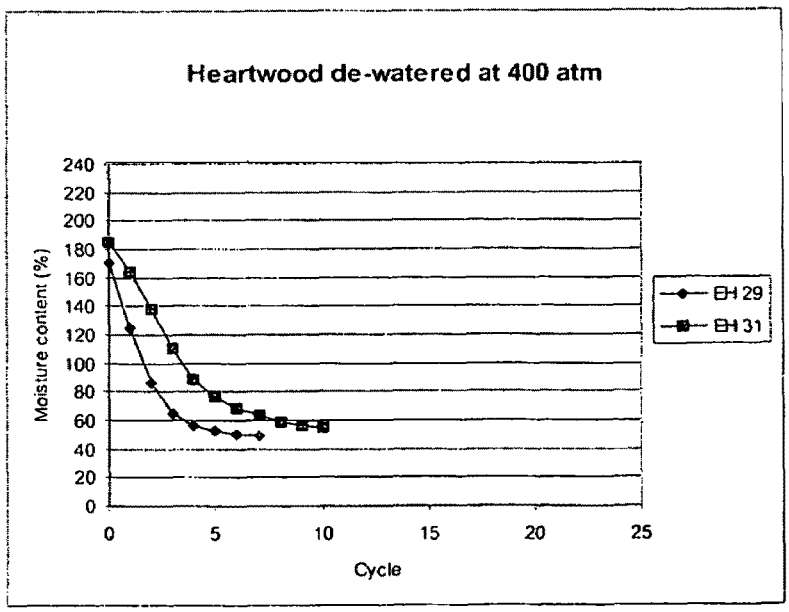
FIG. 18 is a graph showing the reduction of *E. nitens* green heartwood moisture content through supercritical carbon dioxide at 400 atm, 50° C. and with a 2-minute holding time.

Referring to FIGS. 15 and 16, the sapwood samples were variable and only half the samples dewatered satisfactorily. Conversely, referring to FIGS. 17 and 18, between seven and twelve cycles were required to dewater the heartwood samples from green to a moisture content between 46% and 78%.

Figure 19:
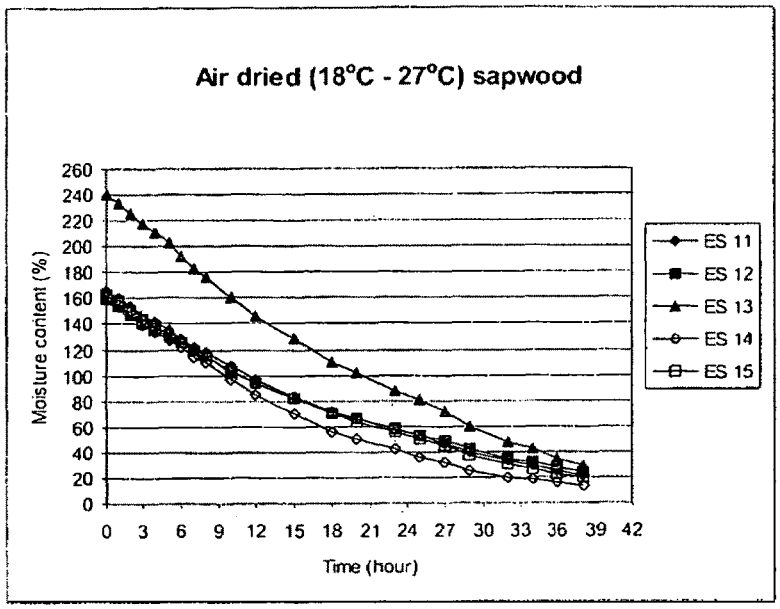
FIG. 19 is a graph showing the reduction of *E. nitens* green sapwood moisture content through air-drying.
Figure 20:
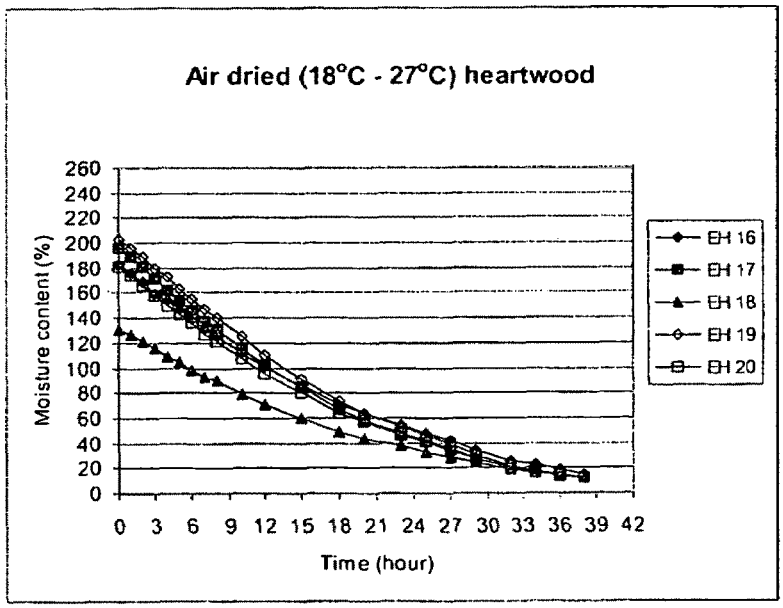
FIG. 20 is a graph showing the reduction of *E. nitens* green heartwood moisture content through air-drying.

Referring to FIG. 19, ambient air-drying of the heartwood samples took 18 hours from green to a moisture content between 49% and 73%. A further 20 hours were required to bring the moisture content to about 12-16%. A total of 38 hours were therefore needed to air dry the wood from green to 12-16% moisture content.

Previous laboratory-scale experiments showed that the rate of further drying the samples after $CO_2$ treatment was the same as for wood that had not been $CO_2$ treated. If the initial air drying time (18 hours) was replaced with the longest supercritical $CO_2$ dewatering time (48 minutes=12×2-minute hold+12×1-minute pressurisation+12×1-minute depressurisation), the time taken to reduce the moisture content from green to approximately 40-80% would be 48 minutes. If the air drying process is then employed to reduce this to a moisture content of 12-16%, this second drying stage would take 20 hours as noted above. In total, an estimated 21 hours would be required to dry the wood from green to 12-16% moisture content using a combination of supercritical $CO_2$ dewatering and air-drying. This combined process applied to *E. nitens* heartwood would approximately halve the time required for air-drying only.

Example 3

Wood Modification for Enhancement of Biological Durability

Figure 21:
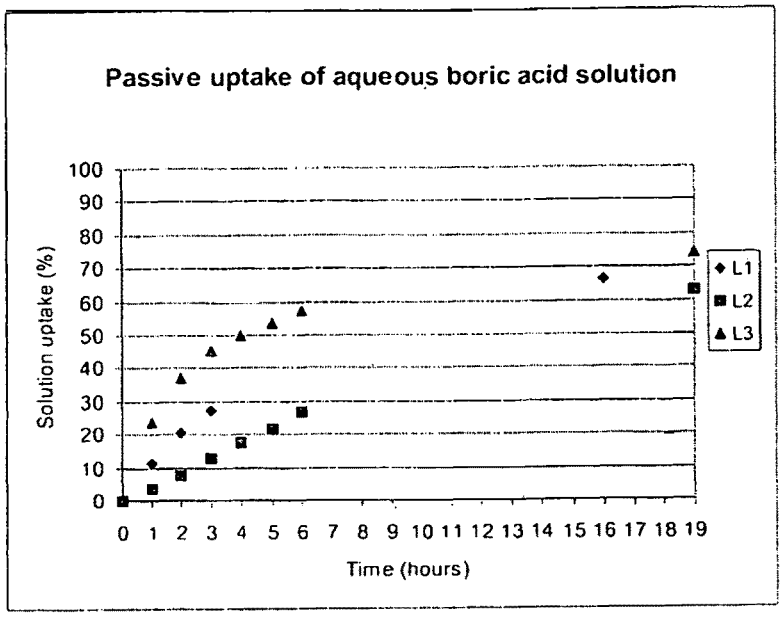
FIG. 21 is a graph showing the passive (atmospheric pressure and 20° C.) uptake of boric acid aqueous solution into three example radiata pine boards which had been dewatered using supercritical $CO_2$ to the fibre saturation point.

Radiata pine boards (100 mm×50 mm nominal, 1.5 m long), were dewatered using multiple pressure cycles of carbon dioxide as described in examples above. Each board was weighed before being placed in the pressure vessel. Five pressure cycles, at 200 atm and 45° C., were applied and after each CO2 pressure cycle, the boards were weighed. The dewatering process was stopped when the recorded rate of change of weight loss was minimal, approaching zero. When the cycles were completed, the boards were immediately submerged in an aqueous solution of boric acid at a concentration required to give a target concentration in the final wood material, e.g., to achieve a 0.4% w/w retention of boric acid in wood with density 500 kg/m$^3$ required a boric acid solution of 0.33% w/w. The boards can be either immersed under atmospheric pressure and ambient temperature conditions or at other pressures and temperatures, such as vacuum-pressure cycles and elevated temperatures which are well-known in wood treatment processing. The boards were removed at intervals and their weights recorded as a measure of passive uptake of the boric acid solution. An example of the rate of uptake of an aqueous solution of boric acid into radiata pine dewatered sapwood is shown in FIG. 21.

Figure 22:
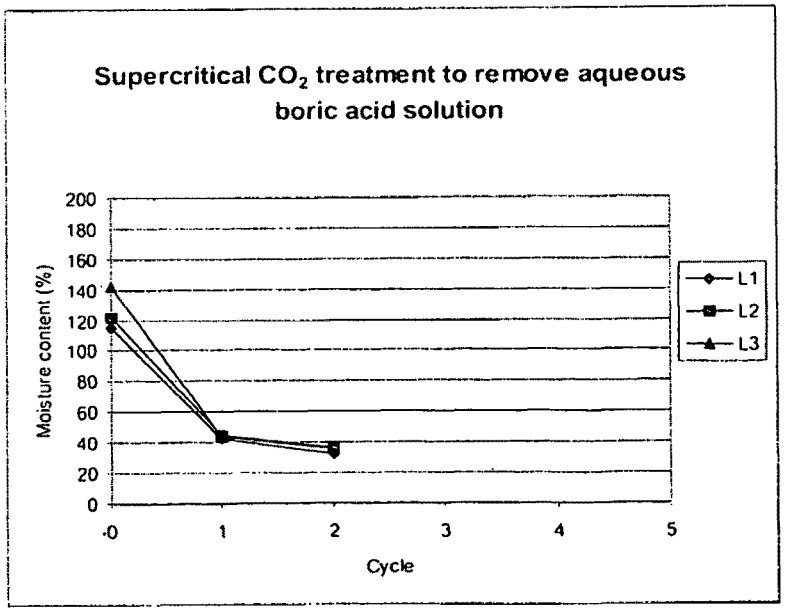
FIG. 22 is a graph showing the second-stage supercritical CO2 process for removal of boric acid aqueous solution from cell lumens of treated wood material, leaving only boric acid solution diffused into cell walls.

The treated boards were then either allowed to dry passively (or kiln-dried) or were kept for a period of time e.g., 12 hours, at ambient or elevated temperature and atmospheric pressure to allow for internal diffusion of the boric acid solution from wood cell lumens containing the wood treatment solution into the wood cell walls. In this process, the residual wood moisture in the cell walls is exchanged with the wood treatment solution in the cell lumens. After this period of time, the treated boards were supercritical $CO_2$ de-watered for a second time using CO2 under conditions used for the initial dewatering, described above. Use of identical conditions for the first and second stage de-watering is not critical. The rate of removal of the residual boric acid solution in the cell lumen is shown in FIG. 22. This rate was faster than the first supercritical $CO_2$ dewatering step, and this faster second-stage dewatering is consistent in all processes involving two supercritical $CO_2$ dewatering steps for producing dry, chemically-treated wood for modifying material biological durability. The treated wood material thus obtained can then be allowed to passively dry or be finally kiln-dried, depending on the initial moisture content of the wood product required by end-users. Boric acid treated wood material produced in the manner described above has an equilibrium moisture content of 10-15%. The mechanical properties of radiata pine wood dewatered and treated in the above-described manner are similar to those of conventionally-dried and treated wood material, e.g., average modulus of rupture (MoR) of 50 MPa and modulus of elasticity (MoE) of 9 GPa. That the high pressures used in the process did not cause any cell-wall damage and loss of strength and stiffness properties is supported by microscopy examination of the cell walls which show no delamination of other observable damage.

The above example using boric acid for treating wood using the supercritical $CO_2$ dewatering process is non-limiting in scope and one of a number of such processes which can be carried out using biocides which are water-soluble or which can be formulated into aqueous solution by use of emulsifiers, e.g., quaternary ammonium compounds and water-compatible co-solvents, e.g., N-methylpyrrolidone,

Example 4

Samples of *P. radiata* sapwood in green condition were weighed and then placed in a 122 ml, reactor vessel preheated to a temperature of 50° C. The vessel was pressurised to 200 atm with supercritical $CO_2$ and this pressure held for 2 minutes. It took an average of 1 minute 27 seconds to pressurise the vessel and an average of 29 seconds to depressurise the vessel. The sample was taken from the vessel and the wood weight recorded. This procedure was repeated until the weight loss recorded was minimal. Once the $CO_2$ pressure cycles were completed, the sample was further dried in a microwave oven at full power (output 650 watts, frequency 2,450 MHz). Weights were recorded at timed intervals until near to constant weight.

Figure 24:
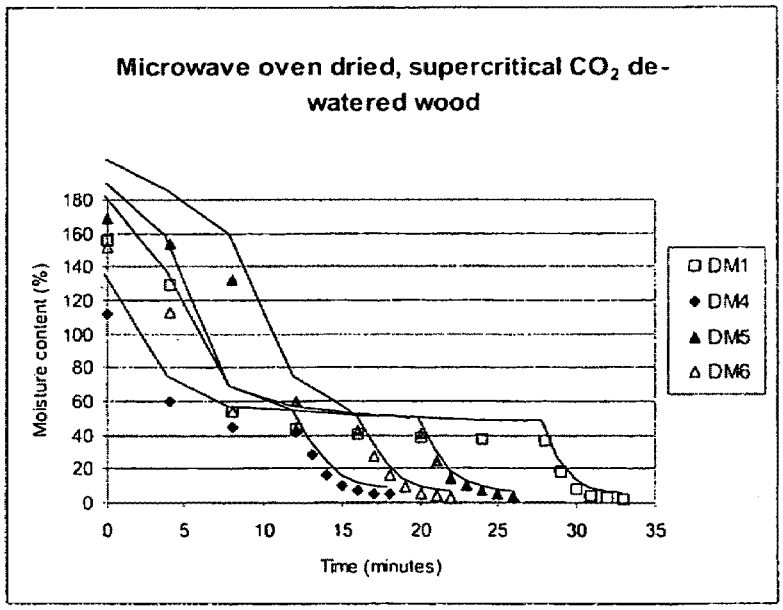
FIG. 24 is a graphical representation of the reduction of moisture content in *Pinus* radiate sapwood using cycles of supercritical $CO_2$ treatment followed by microwave drying.
Figure 25A:
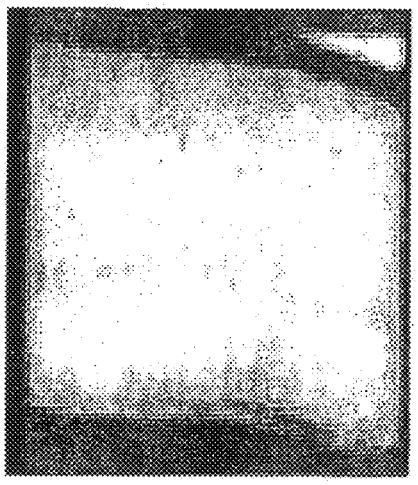
FIG. 25(*a*)-(*d*) is a series of NMR (Nuclear Magnetic Resonance) Spectroscopic images showing the removal of free water from the lumens of green sapwood from greenwood and after each cycle of applying supercritical carbon dioxide.
Figure 25B:
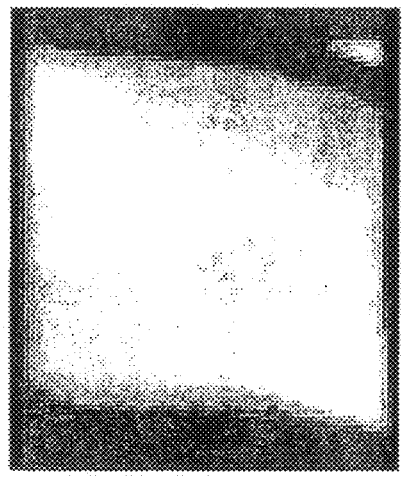
Figure 25C:
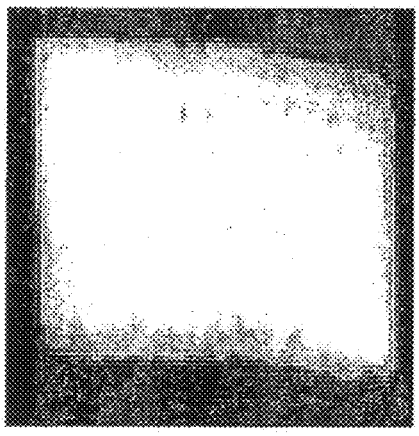
Figure 25D:
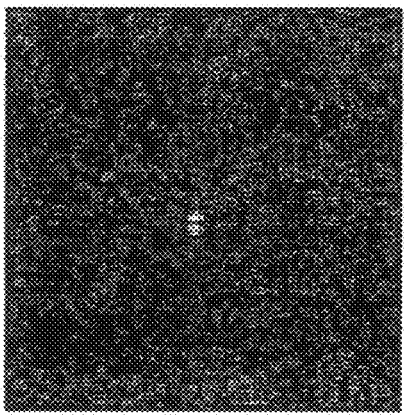
Figure 26A:
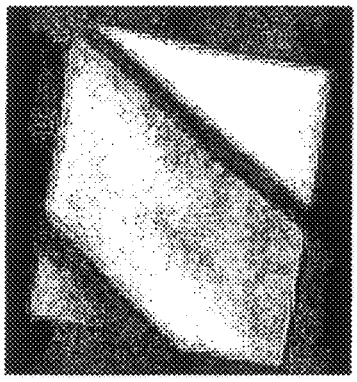
FIG. 26(*a*)-(*e*) is a series of NMR Magnetic Resonance) Spectroscopic images showing the removal of free water from the lumens of green wood from green wood 26(*a*) and after each cycle 26(*b*)-(*e*) of applying supercritical carbon dioxide, the wood sample including two latewood bands and a region of compression wood.
Figure 26B:
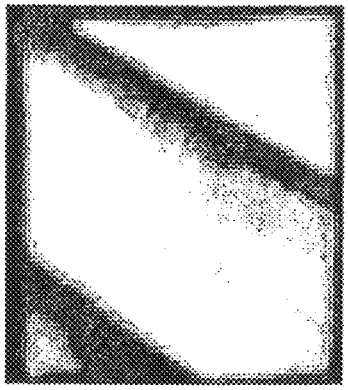
Figure 26C:
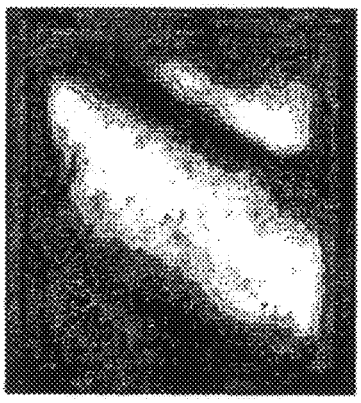
Figure 26D:
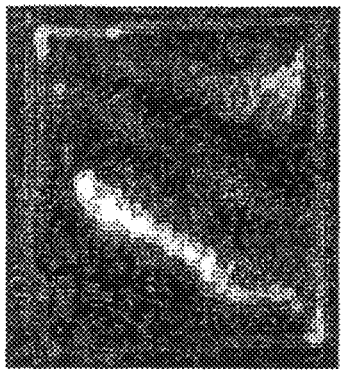
Figure 26E:
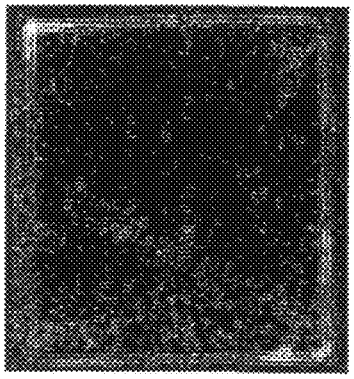
Figure 27:
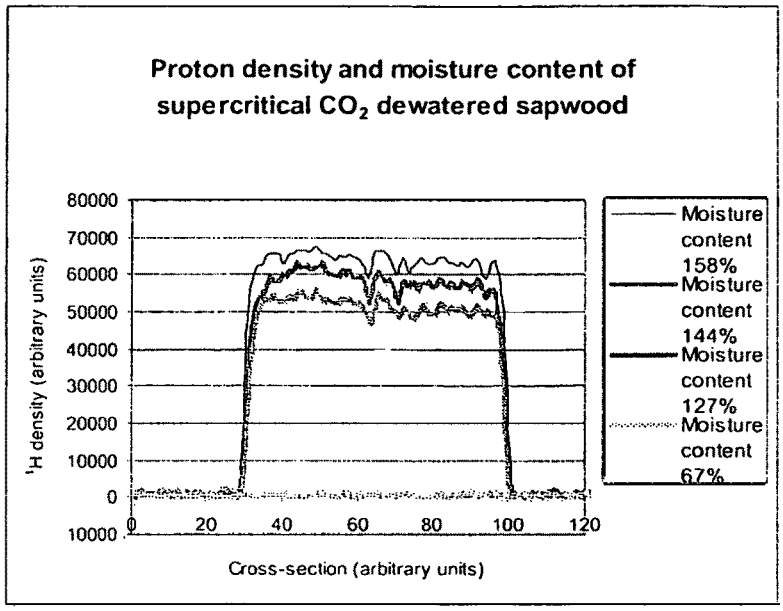
FIG. 27 is a graphical representation of proton density and moisture content of the sapwood shown in the FIG. 25 NMR images with the darkest line representing the wood in its fully green (pre-processed) state and the next lighter, next lighter again, and lightest lines showing proton density after the three cycles of supercritical $CO_2$ treatment.
Figure 28:
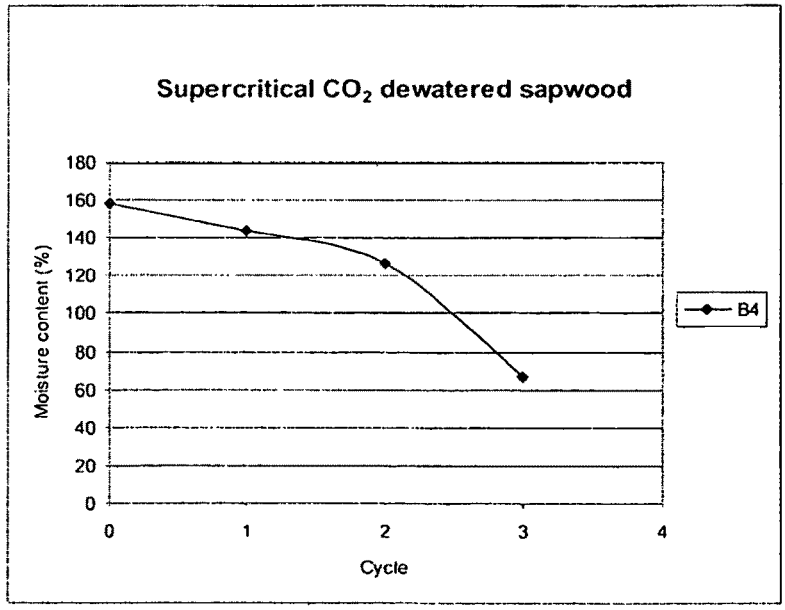
FIG. 28 is a graphical representation in the reduction of moisture content of the sapwood shown in the FIG. 25 NMR images.

FIG. 24 shows the rate of de-watering for each $CO_2$ pressure cycle and the rate of further drying in the microwave oven. It can be observed that the number of cycles required to reach the near to constant moisture contents were typically 3 to 7. For example 7 cycles were performed for the sample DM1, 5 cycles for DM5, 4 cycles for DM6 and 3 cycles for DM4. Each pressure cycle of 2 minutes also included a 2 minute allowance for both pressurisation and depressurisation. The data show that for wood drying alone 5 sequences of application of supercritical $CO_2$—gaseous $CO_2$ cycling followed by microwave drying is sufficient to produce satisfactory dry wood material. Moisture content in the wood reached 2%.

FIG. 25(*a*)-(*d*) shows NMR images of green radiata sapwood undergoing drying by application of cycles of supercritical $CO_2$ at 45 degrees Celsius and 200 bar. The NMR imaging shows proton density effectively showing free water in the lumen of the wood as areas of brightness. After 4 cycles the moisture content of the wood has reduced from the original 158% to 144% to 127% to 67% (image 25(*d*)). Image (d) is substantially black meaning there is an absence of free water in the lumen of the wood. At a moisture content of 67% all remaining water is bound in cell walls. The images show that in a wood sample of substantially homogenous nature that the removal of free water by supercritical $CO_2$ is quite uniform. The moisture content of the wood having all free water removed is slightly higher than the usual estimations of fibre saturation point, however, the absence of free water is evident, so the variation may be the result of the limitations of established methods of measuring FSP and due to the unique nature of any given piece of wood. As shown in the Examples described herein (e.g. with reference to FIGS. 11-14) there is no substantial further moisture reduction caused by the action of supercritical $CO_2$ if further cycles are applied.

FIG. 26(*a*)-(*e*) shows NMR images of the supercritical drying process applied to a piece of wood containing latewood rings (late wood bands also shown at the top and bottom of the sapwood images (FIG. 25)) and compression wood. Interestingly, the latewood in this sample shows virtually no free water even when fully green. Further it is apparent that the free water in the compression wood (the areas of brightness remaining in images (c) and (d)) shows a resistance to removal and it takes two more cycles to remove the water from the compression wood than it does from the surrounding wood. The use of supercritical CO2 drying allows the cell walls of the surrounding wood to remain in a green state while the free water in the compression wood is removed. In conventional drying the cell walls in the surrounding wood would likely be desiccated to a greater or lesser degree by the time the free water is removed from the compression wood. As a result the compression wood cell walls would remain fully swollen and green while at the same time the cell walls of the surrounding wood would be at less than FSP and be experiencing the changes in structure, strength and dimension that occur with the drying of cell walls. The consequence would be a greater likelihood of warping and checking.

There is the possibility that due to the absence of lumen water, latewood may be more susceptible to advanced cell wall drying and degradation when subjected to conventional drying techniques. This may also contribute to checking.

The retention of the green cell wall state throughout the wood and the reduction in moisture gradients across the wood (when compared to traditional drying techniques) result in lower distortion rates using supercritical $CO_2$ drying than are experienced in traditional drying methods.

Through the combined process of green wood material dewatering using supercritical $CO_2$, treatment of the dewatered wood material with aqueous-based biocides formulations and employing a second-stage dewatering step using supercritical $CO_2$, treated wood material of utility value can be obtained more rapidly and with final material quality better than that obtained by using conventional kiln-drying, treating with chemical formulations and re-drying.

The foregoing describes the invention including preferred forms thereof for the supercritical carbon dioxide process for producing dry wood material or for producing wood material at or above fibre saturation to facilitate further wood modification, such as treatment with biocides for biological durability enhancement and with polymers for physical durability enhancement. Alterations and modifications as will be obvious to those skilled in the art are intended to be incorporated within the scope hereof ad defined in the accompanying claims.

The invention claimed is:

1. A process for removing water and solutes from the lumens of green wood, which comprises subjecting green wood to supercritical carbon dioxide in cycles of pressurisation and followed by depressurisation to remove water and solutes from the cell lumens of the green wood while leaving the cell walls throughout the wood uniformly fully swollen.

2. A process according to claim 1 including subjecting the green wood to the supercritical carbon dioxide in cycles of pressurisation to a supercritical pressure followed by depressurisation to a sub-critical pressure.

3. A process according to claim 2 including subjecting the green wood said cycles at temperatures above 32° C.

4. A process according to claim 1 wherein said cycles are between pressures in the range 72>200 bar and 1-72 bar.

5. A process according claim 1 including subjecting the green wood to the supercritical carbon dioxide in cycles of pressurisation to a supercritical pressure followed by a holding time at elevated supercritical pressure followed by depressurisation to a sub-critical pressure.

6. A process according to claim 1 including subjecting the wood to the supercritical carbon dioxide in cycles of pressurisation to a supercritical pressure followed by a holding time between about 10 and about 25 minutes at supercritical pressure followed by depressurisation to a sub-critical pressure.

7. A process according to claim 1 wherein the green wood has a moisture content in the range about 180% to about 150% of the oven dry weight of the wood.

8. A process according to claim 2 wherein the green wood has a moisture content in the range about 180% to about 150% of the oven dry weight of the wood.

9. A process according to claim 1 including subjecting the green wood to supercritical carbon dioxide until the moisture content of the wood is in the range about 30 to about 80% of the oven dry weight of the wood.

10. A process according to claim 2 including subjecting the green wood to supercritical carbon dioxide until the moisture content of the wood is in the range about 30 to about 80% of the oven dry weight of the wood.

11. A process according to claim 7 including subjecting the green wood to supercritical carbon dioxide until the moisture content of the wood is in the range about 30 to about 80% of the oven dry weight of the wood.

12. A process according to claim 1 including subjecting the green wood to supercritical carbon dioxide until the moisture content of the wood is at or about the fibre saturation point of the wood.

13. A process according to claim 2 including subjecting the green wood to supercritical carbon dioxide until the moisture content of the wood is at or about the fibre saturation point of the wood.

14. A process according to claim 7 including subjecting the green wood to supercritical carbon dioxide until the moisture content of the wood is at or about the fibre saturation point of the wood.

15. A process according to claim 1 including further drying the wood to a moisture content of in the range about 12 to about 20% of the oven dry weight of the wood.

16. A process according to claim 2 including further drying the wood to a moisture content of in the range about 12 to about 20% of the oven dry weight of the wood.

17. A process according to claim 7 including further drying the wood to a moisture content of in the range about 12 to about 20% of the oven dry weight of the wood.

18. A process according to claim 15 comprising carrying out the further drying by subjecting the wood to any one or more of air- azeotropic-, freeze-, electromagnetic radiation-such as radio frequency- and microwave-, or kiln-drying or additional supercritical fluid processing.

19. A process according to claim 15 comprising carrying out the further drying by subjecting the wood to any one or more of radio frequency-and microwave-drying.

20. A process according to claim 16 comprising carrying out the further drying by subjecting the wood to any one or more of radio frequency-and microwave-drying.

21. A process according to claim 15 including treating the wood with a liquid formulation effective to increase biological durability or physical durability after said removing water but before said further drying.

22. A process according to claim 19 including treating the wood with a liquid formulation effective to increase biological durability or physical durability after said removing water but before said further drying.

23. A process according to claim 20 including treating the wood with a liquid formation effective to increase biological durability or physical durability after said removing water but before said further drying.

24. A process according to claim 1 including carrying out said removing water and further drying in less than about 24 hours.

25. A process according to claim 1 wherein the wood is lumber.

26. A process according to claim 2 wherein the wood is lumber.

27. A process according to claim 7 wherein the wood is lumber.

28. A process according to claim 15 wherein the wood is lumber.

29. A process according to claim 18 wherein the wood is lumber.

30. A process according to claim 23 wherein the wood is lumber.

31. A process for processing sawn lumber comprising the steps of:

removing water from lumber having a moisture content above the fibre saturation point of the lumber by subjecting the lumber to supercritical carbon dioxide to reduce the lumber to a moisture content in the range about 30 to about 80% of the oven dry weight of the lumber while leaving the cell walls throughout the wood uniformly fully swollen;

treating the lumber with a liquid formulation effective to increase biological durability or physical durability of the lumber;

and then further reducing the moisture content of the lumber by air, azeotropic-, freeze-, radio frequency-, microwave-, or kiln-drying the lumber to a moisture content in the range about 12 to about 20% of the oven dry weight of the lumber.

32. A process according to claim 1, including leaving the cell walls throughout the wood uniformly fully swollen and the cell wall pits open.

33. A process according to claim 31, including leaving the cell walls throughout the wood uniformly fully swollen and the cell wall pits open.

* * * * *

UNITED STATES PATENT AND TRADEMARK OFFICE

CERTIFICATE OF CORRECTION

PATENT NO. : 8,578,625 B2
APPLICATION NO. : 12/312424
DATED : November 12, 2013
INVENTOR(S) : Franich et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1113 days.

Signed and Sealed this
Twenty-second Day of September, 2015

Michelle K. Lee

Michelle K. Lee
*Director of the United States Patent and Trademark Office*